US012734635B2

(12) United States Patent
Schneider

(10) Patent No.: US 12,734,635 B2
(45) Date of Patent: Sep. 15, 2026

(54) PROCESSING SYSTEM FOR PROCESSING SPECTACLE LENSES

(71) Applicant: SCHNEIDER GmbH & Co. KG, Fronhausen (DE)

(72) Inventor: Gunter Schneider, Marburg (DE)

(73) Assignee: SCHNEIDER GmbH & Co. KG, Fronhausen (DE)

( * ) Notice: Subject to any disclaimer, the term of this patent is extended or adjusted under 35 U.S.C. 154(b) by 708 days.

(21) Appl. No.: 17/267,246

(22) PCT Filed: Aug. 14, 2019

(86) PCT No.: PCT/EP2019/071778
§ 371 (c)(1),
(2) Date: Feb. 9, 2021

(87) PCT Pub. No.: WO2020/048748
PCT Pub. Date: Mar. 12, 2020

(65) Prior Publication Data

US 2021/0170540 A1 Jun. 10, 2021

(30) Foreign Application Priority Data

Sep. 4, 2018 (DE) ..... 10 2018 006 983.5
Sep. 14, 2018 (DE) ..... 10 2018 007 254.2
Sep. 24, 2018 (DE) ..... 10 2018 007 494.4

(51) Int. Cl.
*B24B 13/00* (2006.01)

(52) U.S. Cl.
CPC ..... *B24B 13/0031* (2013.01); *Y10T 29/5109* (2015.01)

(58) Field of Classification Search
None
See application file for complete search history.

(56) References Cited

U.S. PATENT DOCUMENTS 6,379,215 B1 4/2002 Mizuno et al.
7,153,184 B2 12/2006 Kuebler et al.
9,840,373 B2 12/2017 Schneider
9,908,714 B2 3/2018 Schneider
10,406,646 B2 9/2019 Schneider et al.
(Continued)

FOREIGN PATENT DOCUMENTS

CN 201448381 U 5/2010
CN 102653069 A 9/2012
(Continued)

OTHER PUBLICATIONS

Invitation to Pay Additional Fees and, Where Applicable, Protest Fee for International Application No. PCT/EP2019/071778, mailed Nov. 18, 2019.
(Continued)

*Primary Examiner* — Brian D Keller
*Assistant Examiner* — Jason Khalil Hawkins
(74) *Attorney, Agent, or Firm* — Jason H. Vick; Amped IP LLC

(57) ABSTRACT

A processing system for processing spectacle lenses and a method for processing spectacle lenses are proposed. The processing system has several processing stations, in particular a milling station, a turning station, a polishing station, a cleaning station and/or a signing station. Furthermore, the processing system has a transport system for transporting the spectacle lenses and/or transport containers for the spectacle lenses. Preferably, the processing system also has a common base frame and/or a common casing for the processing stations. In the processing system and/or with the method, several spectacle lenses can be processed simultaneously in different processing stations.

12 Claims, 17 Drawing Sheets

(56) References Cited

U.S. PATENT DOCUMENTS

Figure 1:
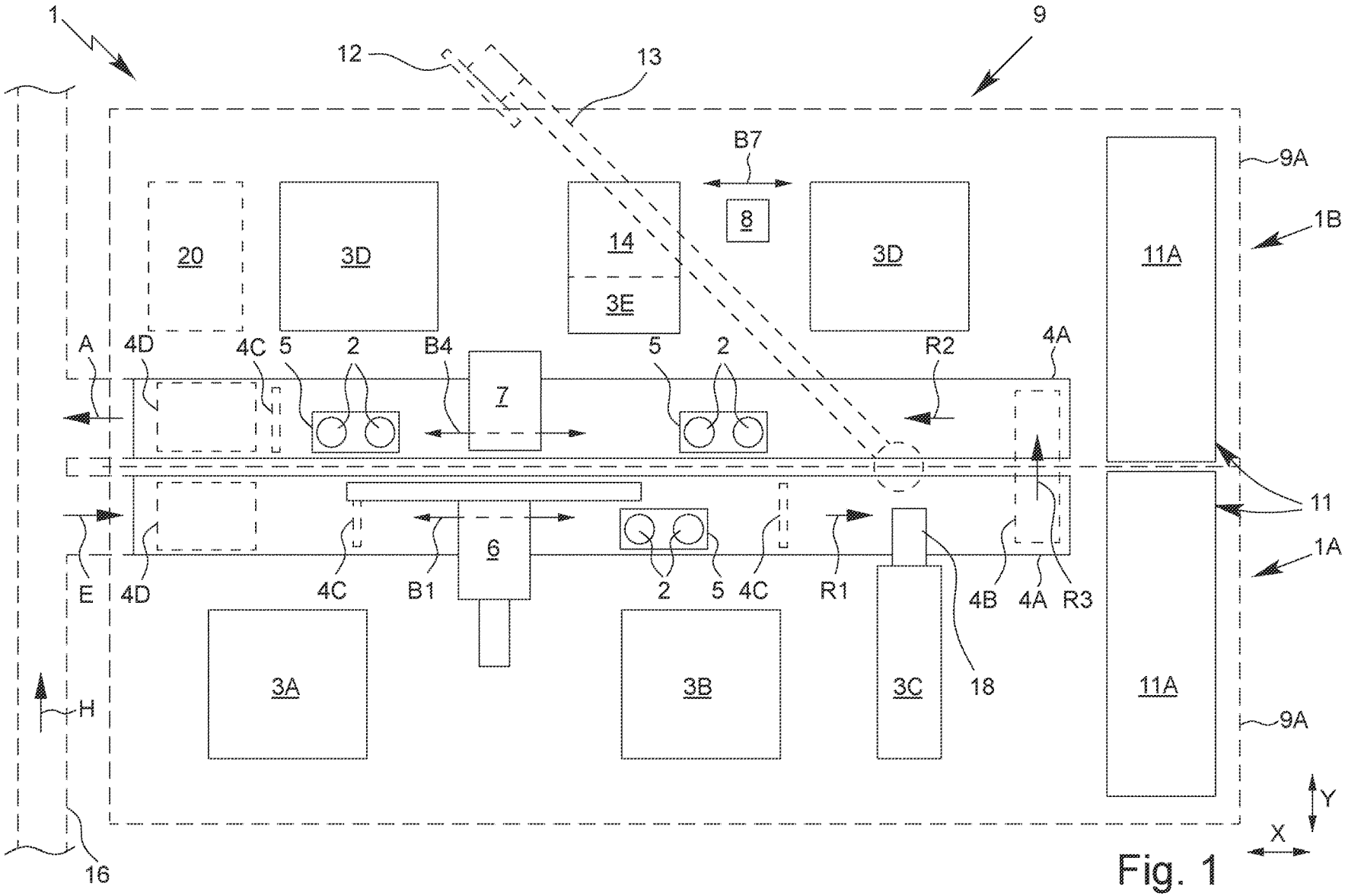

| | | | | |
|---|---|---|---|---|
| 10,781,050 | B2 | 9/2020 | Schneider | |
| 2006/0009126 | A1* | 1/2006 | Kuebler | B24B 13/02 451/41 |
| 2013/0072088 | A1* | 3/2013 | Schneider | B23B 5/00 451/442 |
| 2014/0038494 | A1 | 2/2014 | Schneider et al. | |
| 2014/0073227 | A1 | 3/2014 | Schneider et al. | |
| 2014/0228995 | A1* | 8/2014 | Tanaka | B24B 27/0023 700/112 |
| 2015/0053530 | A1* | 2/2015 | Schneider | B24B 13/0037 198/348 |
| 2016/0250690 | A1* | 9/2016 | Mandler | B23B 3/32 82/1.11 |
| 2017/0348823 | A1* | 12/2017 | Gerrath | B24B 27/0069 |
| 2020/0215657 | A1* | 7/2020 | Schneider | B29D 11/00942 |

FOREIGN PATENT DOCUMENTS

| | | | |
|---|---|---|---|
| CN | 207289588 | U | 5/2018 |
| CN | 207668645 | U | 7/2018 |
| DE | 29823464 | U1 | 6/1999 |
| DE | 102005057725 | A1 | 6/2007 |
| DE | 69926848 | T3 | 12/2011 |
| DE | 202012011690 | U1 | 3/2013 |
| EP | 1554082 | B1 | 7/2007 |
| KR | 2008-0057920 | A | 6/2008 |
| WO | WO 2013/131656 | | 9/2013 |

OTHER PUBLICATIONS

International Search Report for International Application No. PCT/EP2019/071778, mailed Jan. 15, 2020.

Written Opinion for International Application No. PCT/EP2019/071778, mailed Jan. 15, 2020.

International Preliminary Report on Patentability for International Application No. PCT/EP2019/071778, mailed Mar. 18, 2021.

"Technik für neue Ansprüche an Brillengläser (Technology for New Demands on Spectacle Lenses)" Der Augenoptiker (The Optician), 50, 51.—ISSN 0004-7929; Feb. 3, 2003 (Includes a machine translation).

* cited by examiner

PROCESSING SYSTEM FOR PROCESSING SPECTACLE LENSES

CROSS-REFERENCE TO RELATED APPLICATIONS

This application is a national stage application under 35 U.S.C. 371 of PCT Application No. PCT/EP2019/071778 having an international filing date of 14 Aug. 2019, which designated the United States, which PCT application claimed the benefit of German Application No. 10 2018 006 983.5, filed 4 Sep. 2018, German Application No. 10 2018 007 254.2, filed 14 Sep. 2018, and German Application No. 10 2018 007 494.4, filed 24 Sep. 2018, each of which are incorporated herein by reference in their entirety.

The present invention relates to a processing system for processing spectacle lenses according to the generic concept of the claims appended hereto, and to a method for processing spectacle lenses according to the claims appended hereto.

Numerous solutions for processing optical or spectacle lenses are known from the prior art.

WO 2013/131656 A2 describes a system and a method for processing optical lenses. The processing is carried out by means of various separate processing devices for independent processing of the lenses. Each processing device has its own conveying device, which is controlled by the processing device itself. A transfer device is arranged between each of the processing devices. Lenses are preferably transferred between the processing devices by conveyor belts. The system allows a very flexible processing of lenses which can be adapted to different needs. In certain areas of application, however, a processing system with a smaller footprint is desirable.

A device for milling, turning and polishing lenses is known from DE 10 2005 057 725 A1. The device has a movably mounted workpiece spindle so that a lens held by the workpiece spindle can be processed successively with a milling tool and a turning tool and then polished. It is therefore not possible to process several lenses simultaneously in the fixture.

EP 1 554 082 B1 describes a process for polishing and signing optical glasses, whereby the polishing and signing steps are carried out in a common production cell and the glasses are handled by the same robot during polishing and signing. The manufacturing cell comprises a polishing station, a washing station and a signing station. In particular, this document relates to a manufacturing process that takes place after a machining by grinding or turning. All handling operations between individual stations as well as, in part, the processing steps themselves are performed by the same robot. This means that only a single handling element is required for all operations within the production cell. The disadvantage is the low throughput.

It is an object of the present invention to provide an apparatus and a method, wherein a low space requirement exists, a processing or surface processing of spectacle lenses which is as complete or extensive as possible can be realized and/or a high throughput of processed spectacle lenses per time unit can be achieved.

The above object is solved by a processing system or by a method according to the claims appended hereto. Advantageous further developments are the subject of the subclaims.

A processing system according to the proposal has several processing stations which (can) operate in particular simultaneously and/or independently of each other. Preferred examples of processing stations are a milling station, a turning station, a cleaning station, a polishing station and/or a signing station. The processing system can have any combination of said processing stations, in particular also several stations of the same type, for example two polishing stations. The several processing stations enable extensive or as complete as possible processing or surface processing (surfacing) of spectacle lenses in the processing system.

Furthermore, the processing system preferably has a common base frame and/or a common housing or casing for the processing stations.

A common base frame on which one or more processing stations are arranged and/or which supports the processing station(s) enables a compact and simple assembly of the processing system. In particular, this also facilitates transport of the processing system from the manufacturer to the installation site as well as installation and commissioning of the processing system at the installation site.

The casing or housing is designed in particular in such a way that the processing stations are surrounded by it or are arranged within it. Hereby, the desired operational reliability of the processing system is achieved.

Preferably, the processing system has a transport system for transporting the spectacle lenses or transport containers for the spectacle lenses within the processing system. This enables fully automated conveying and processing of the spectacle lenses in the processing system.

According to a first aspect of the present invention, the processing system is preferably configured to process different spectacle lenses simultaneously in different processing stations. The processing stations are selected from the group consisting of the milling station, the turning station and the polishing station. In other words, the processing system is preferably designed to simultaneously mill and turn different spectacle lenses, simultaneously mill and polish different spectacle lenses, and/or simultaneously turn and polish different spectacle lenses. This is conducive to high throughput.

According to a further aspect that can also be implemented independently, the transport system preferably has transport sections or transport devices that run parallel to one another and are preferably directly adjacent or arranged next to one another. The transport devices are preferably designed as conveyor belts. The arrangement of the transport devices with respect to each other minimizes the footprint or installation area of the processing system and enables a cost-effective and compact design of the processing system. In addition, access to different processing stations, for example for cleaning, inspection, maintenance, repair or replacement of parts, is facilitated.

Preferably, the transport devices of the transport system have opposite transport directions and/or the spectacle lenses or transport containers with the spectacle lenses are transported in opposite directions. This is conducive to a compact design of the processing system.

Alternatively or additionally, an entrance and an exit or a pick-up and delivery of the transport system are preferably arranged directly adjacent to each other or next to each other and/or on the same side of the processing system. This is conducive to a compact design of the processing system.

The processing stations are preferably arranged at least partially below and/or laterally, in particular on sides facing away from each other, of the transport system. This is conducive to a compact design and easy access to the processing stations, for example for inspection, maintenance, servicing or repair.

According to a further aspect of the present invention, which can also be implemented independently, the base frame preferably has several, in particular two, subframes, which can be connected to one another and each form a base frame for one or more processing stations. In particular, the subframes are interconnectable on site, i.e. at a location where the processing system is set up or put into operation. This facilitates transport or delivery of the processing system and/or reduces the related costs. In addition, the assembly and/or commissioning of the processing system can be accelerated and/or facilitated in this way.

According to a further aspect that can also be implemented independently, the processing system preferably has at least one handling apparatus for the spectacle lenses and/or for tools for processing the spectacle lenses. The handling apparatus is preferably displaceable parallel to the transport system and/or assigned to several processing stations. This is conducive to a compact design or low space requirement of the processing system. In addition, this reduces the costs for the processing system and enables an optimum process sequence or a high throughput.

The processing system preferably has several handling apparatuses designed according to the above aspect, in particular one or more (independent) handling apparatuses for the spectacle lenses and at least one handling apparatus for tools for processing the spectacle lenses, in particular polishing tools. This enables efficient processing and high throughput.

Some preferred aspects of the handling apparatuses are explained below, wherein the features explained below may also be implemented together in one or more handling apparatuses. This will become clear in particular in the later description with reference to the drawings.

The processing system preferably has a handling apparatus which serves to hold spectacle lenses and has a linear movement axis running at least partially above the transport system and/or obliquely to the vertical. Particularly preferably, the handling apparatus has a guide or linear guide which is arranged at least partially above the transport system and/or obliquely to the horizontal and forms or has the movement axis. This is conducive to a compact design of the processing system.

The processing system preferably has several independent handling apparatuses, which are in particular arranged at least substantially above the transport system. This is conducive to a compact design of the processing system.

Preferably, the processing system has a handling apparatus that is designed for handing over spectacle lenses between the transport system and two processing stations. In particular, the handling apparatus is assigned to several processing stations and is preferably designed for handing over spectacle lenses between the transport system and each of the two processing stations and/or for handing over spectacle lenses between the two processing stations. This is conducive to a compact and cost-effective design of the processing system and a high throughput of spectacle lenses.

In particular, the processing system has a handling apparatus with two holding devices on a swivel head for exchanging a spectacle lens at a processing station, in particular a milling and/or turning station. This is conducive to a compact and cost-effective design of the processing system and a high throughput of spectacle lenses.

It is preferred that the processing system has a handling apparatus which is designed for the simultaneous exchange of spectacle lenses at two spectacle lens holders or chucks—preferably of workpiece spindles—of a processing station, in particular a polishing station. The handling apparatus is in particular designed to remove two finished, in particular polished, spectacle lenses from the processing station or polishing station simultaneously or in pairs and/or to insert two spectacle lenses to be processed or polished simultaneously or in pairs into the spectacle lens holders or chucks in the processing station or polishing station. This is conducive to a compact and cost-effective design of the processing system and a high throughput of spectacle lenses.

The processing system preferably has a handling apparatus with several holding devices for holding spectacle lenses, the holding devices being arranged on different arms and/or movable independently of one another. The arms are preferably arranged parallel to one another and/or movable, in particular linearly. In particular, this enables spectacle lenses to be changed quickly. This is conducive to a compact and cost-effective design of the processing system and a high throughput of spectacle lenses.

The processing system preferably has a handling apparatus with two suction cups and two grippers—in particular finger grippers—for holding spectacle lenses. Preferably, the suction cups serve to hold spectacle lenses still to be processed, in particular still to be polished, and the grippers serve to hold spectacle lenses already processed, in particular already polished, preferably only at the edge. This is conducive to a compact and cost-effective design of the processing system and a high throughput of spectacle lenses.

Preferably, the processing system has a handling apparatus which is designed for the simultaneous or paired exchange of tools, in particular polishing tools, at two tool holders of a processing station, in particular polishing station. This is conducive to a compact and cost-effective design of the processing system and a high throughput of spectacle lenses.

The processing system preferably has a handling apparatus with several holding devices for holding tools, in particular polishing tools, wherein the holding devices are arranged on different arms and/or—in particular two pairs of holding devices—can be moved independently of one another. The arms are preferably arranged parallel to one another and/or movable, in particular linearly. This is conducive to a quick change and therefore a high throughput of spectacle lenses.

The processing system preferably has a handling apparatus for exchanging tools, in particular polishing tools, which is assigned to two polishing stations and/or is arranged and/or movable between two processing or polishing stations. This is conducive to a compact and cost-effective design of the processing system and a high throughput of spectacle lenses.

Preferably, the processing system has two polishing stations which are assigned a common tool magazine for polishing tools. This is conducive to a compact and cost-effective design of the processing system and a high throughput of spectacle lenses.

It is advantageous if the processing system or the handling apparatus has a sensor, in particular a sensing device, to determine whether there are one or more spectacle lenses in a transport container. In this way, errors during processing can be avoided and/or fast processes can be achieved.

Preferably, the processing system has an operating apparatus with an input device and a display device. The operating apparatus is preferably used to control or operate the processing system, in particular individual processing stations of the processing system.

According to an aspect that can also be implemented independently, the operating apparatus is preferably arranged on an arm, in particular a pivot arm, and can be moved to opposite sides of the processing system and/or in front of different processing stations. This facilitates operation of the processing system and/or the processing stations.

According to a further aspect which can also be implemented independently, a control menu can preferably be displayed by means of the display device and the display device is designed to display different control menus, in particular for one of the processing stations in each case, depending on a relative position and/or orientation of the operating apparatus with respect to the processing station(s). This facilitates easier and flexible operation of different processing stations of the processing system and improves operating safety.

Preferably, the arm and the operating apparatus are arranged outside the casing or housing of the processing system. In particular, the arm can be at least partially arranged above the housing. The operating apparatus is preferably arranged or arrangeable on an at least substantially vertically extending or lower section of the arm and/or laterally of the casing or housing. This enables convenient operation.

The arm can preferably be pivoted about a vertical axis, in particular by at least 180°, particularly preferably by at least substantially 270° or 360°. This allows flexible positioning of the operating apparatus at a desired position with respect to the processing system or the processing stations.

The arm preferably has several articulated axes and/or sections that are hingedly connected to one another. This is conducive to flexible positioning of the operating apparatus.

Preferably, the operating apparatus is designed for individual control of the respective nearest processing station(s). Alternatively or additionally, the operating apparatus is preferably designed to automatically switch to the nearest processing station or to display a corresponding control menu for the nearest processing station. This facilitates the operation of the processing system or the processing stations.

According to another aspect which can also be implemented independently, the present invention relates to a method for processing spectacle lenses in a processing system having several processing stations and a common base frame and/or a common casing or housing for the processing stations.

Preferably, the method is carried out in or with a processing system according to any of the aspects described above, and/or the processing system described above is configured to carry out the method described below.

In the method, a spectacle lens is processed sequentially in different processing stations of the processing system.

According to one aspect of the method, different spectacle lenses are preferably processed simultaneously in different processing stations, while at least one other spectacle lens is further transported and/or moved to a processing station. This is conducive to a high throughput of spectacle lenses.

According to a further aspect, which can also be implemented independently, different lenses are preferably milled and turned simultaneously in different processing stations. Alternatively or additionally, different lenses are polished and machined simultaneously in different processing stations, in particular milled and/or process by turning. This is conducive to a high throughput of spectacle lenses.

According to a further aspect of the method that can also be realized independently, the spectacle lens is preferably removed from a transport container for processing, processed in different processing stations and then deposited back into the transport container, the transport container being transported further along the processing stations during (before, at the same time and/or after) the processing and/or between the removal and the depositing of the spectacle lens, in particular by means of a transport system. This is conducive to a high throughput of spectacle lenses.

According to another aspect that can also be realized independently, a handling apparatus preferably transfers the spectacle lens after milling in a milling station from the milling station preferably directly to a downstream turning station for turning processing. In particular, it is provided that the handling apparatus takes the spectacle lens directly from a spectacle lens holder or a chuck of the milling station or its workpiece spindle, with which the spectacle lens is held during milling, and/or transfers it directly to a spectacle lens holder or a chuck of the turning station or its workpiece spindle, with which the spectacle lens is held during processing in the turning station. Preferably, therefore, no transfer devices, such as grippers or suction cups, are provided which are interposed between the spectacle lens holders or chucks and the handling apparatus. This is conducive to a high throughput of spectacle lenses.

It is a particular advantage of the present invention that the shaping processing or machining of the spectacle lenses is not carried out in a single processing station which both mills and turns the spectacle lenses, but that the milling and turning are divided or distributed between two separate processing stations. This results in improvements or optimizations in the processing times or the throughput of the processing system, since the milling of the spectacle lenses is usually completed after a significantly shorter time than the turning processing of the spectacle lenses. Turning processing of a spectacle lens typically requires about two to three times the time required for milling. Therefore, by splitting milling and turning, dead times or downtimes of the processing stations, especially the turning station, can be reduced and a higher throughput can be achieved.

In the context of the present invention, the term "turning" with respect to spectacle lenses preferably denotes a machining process of the spectacle lens in which chips are separated from the spectacle lens, in particular in order to produce a desired shape of the spectacle lens. The term "turning" of a spectacle lens particularly refers to a shaping or machining processing, especially preferably a face turning, of the spectacle lens, in particular of a flat side or optical surface of the spectacle lens, and not merely the turning of the spectacle lens about an axis without a (shaping or machining) processing of the spectacle lens. The term "rotating" is preferably used for rotating the spectacle lens without machining.

In particular, the terms "turning" and "turning processing" as well as derivatives thereof are used synonymously here and are interchangeable. The term "turning" is here preferably understood to mean face turning.

According to a preferred method aspect, immediately after removal of the spectacle lens from a processing station with a handling apparatus, a further spectacle lens already stocked by this handling apparatus is transferred to the same processing station. In this way, dead times or downtimes of the processing station during the exchange of spectacle lenses can be reduced and thus the throughput of spectacle lenses can be increased.

Preferably, the same handling apparatus is used to remove the spectacle lens from the transport container, hand it over to a processing station and between two processing stations, remove it from the second processing station and place it back into the (same) transport container. This is conducive to a cost-effective and compact design of the processing system.

The above aspects and features, as well as further aspects and features resulting from the claims and the following description, can be realized independently of each other and in any combination.

Figure 2:
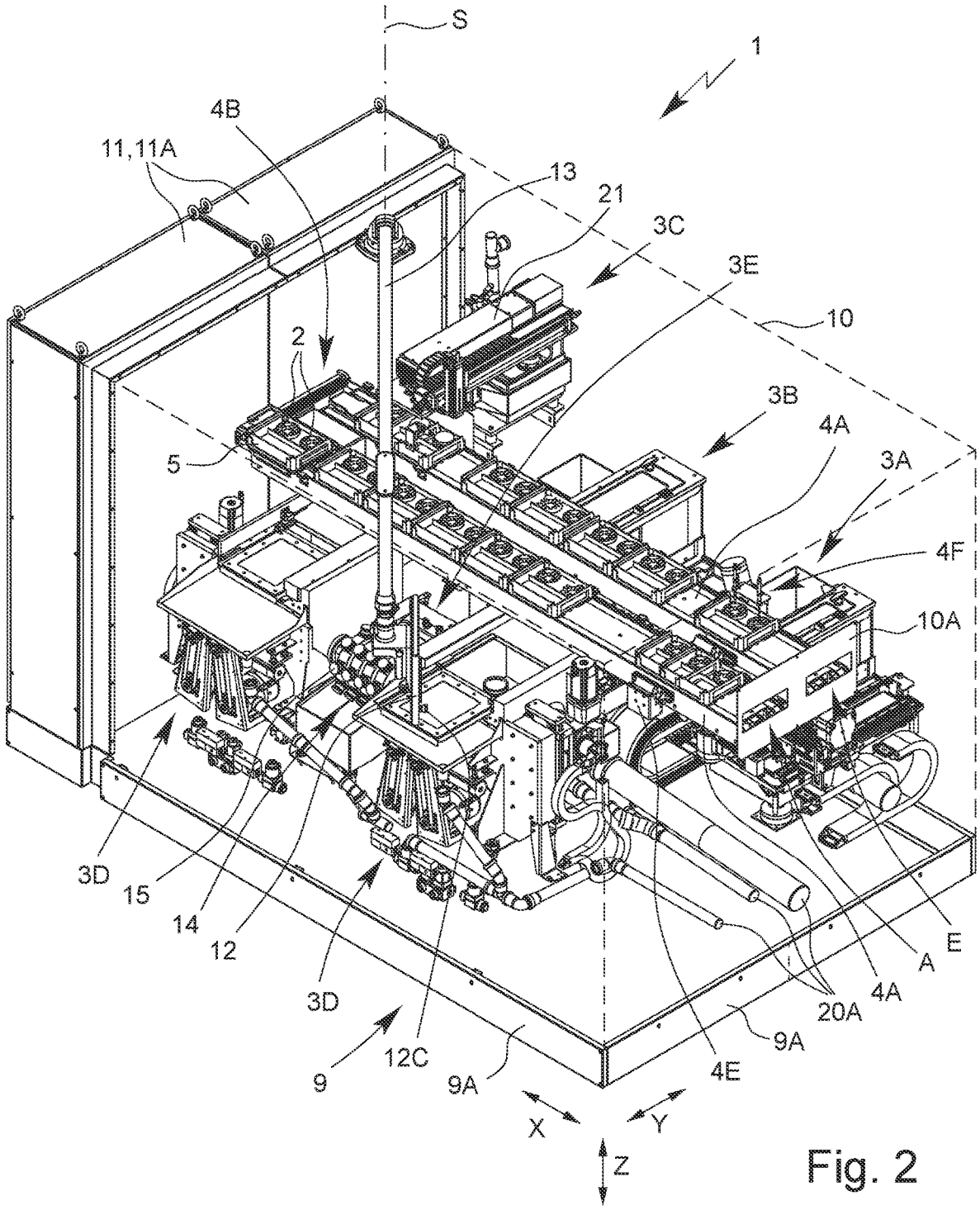
Figure 3:
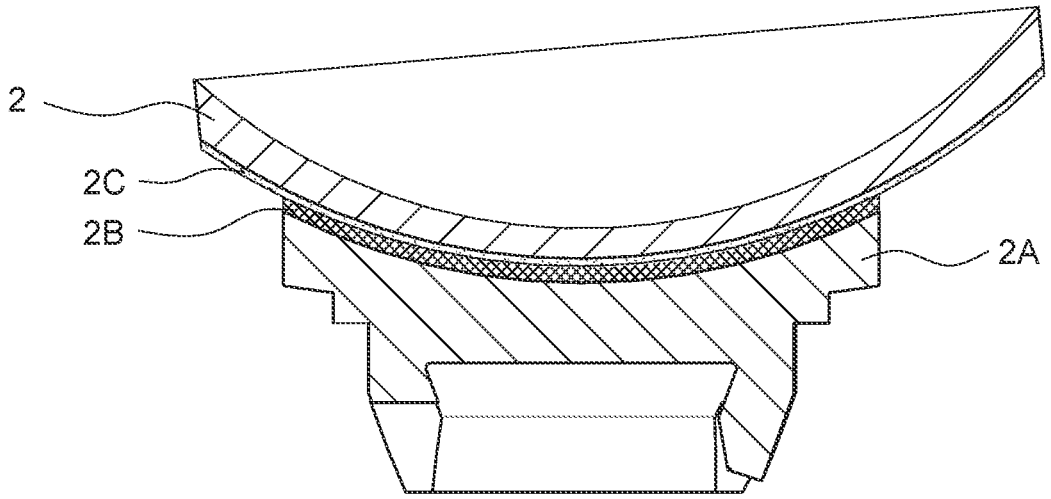
Figure 4:
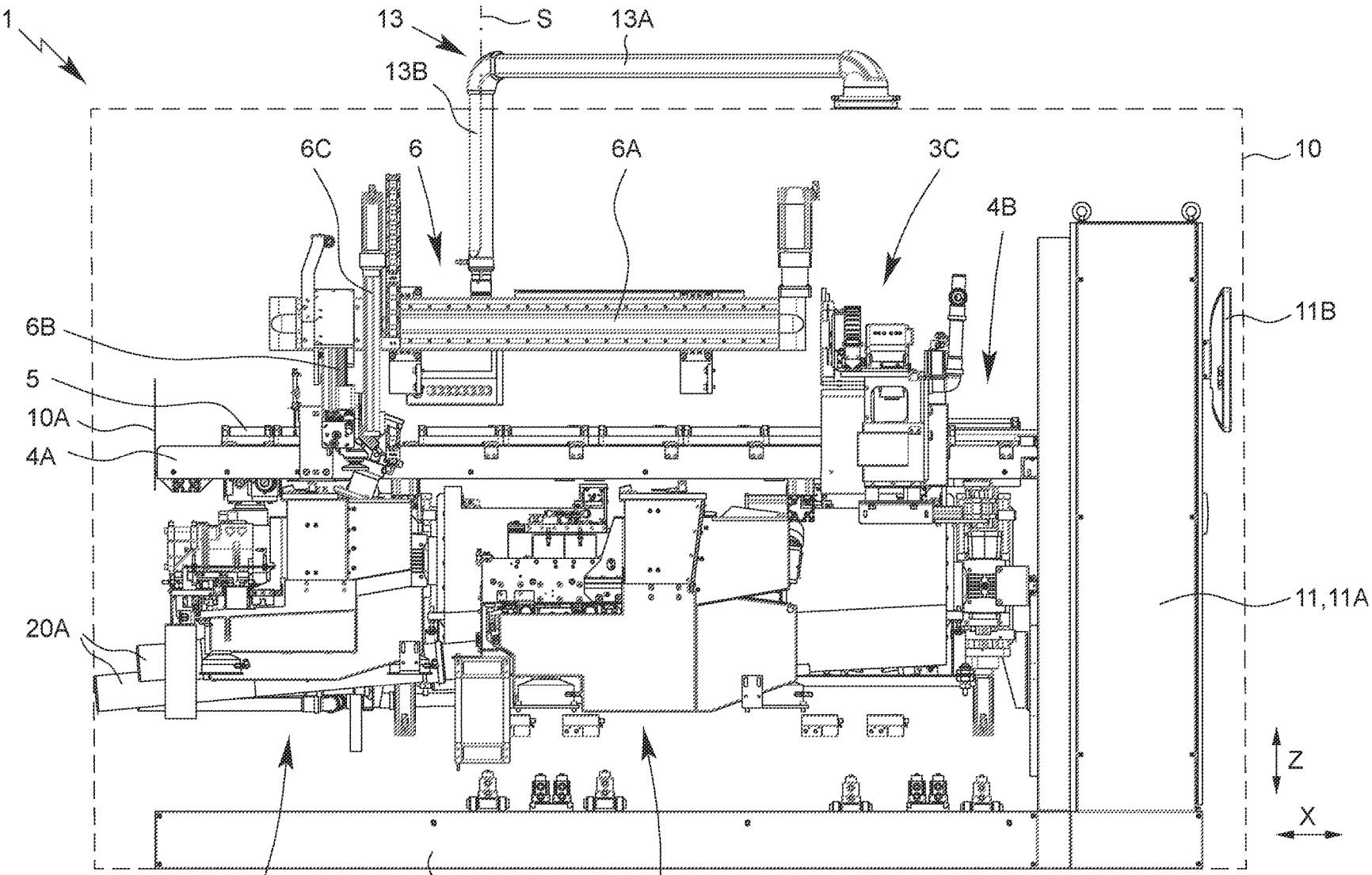
Figure 5:
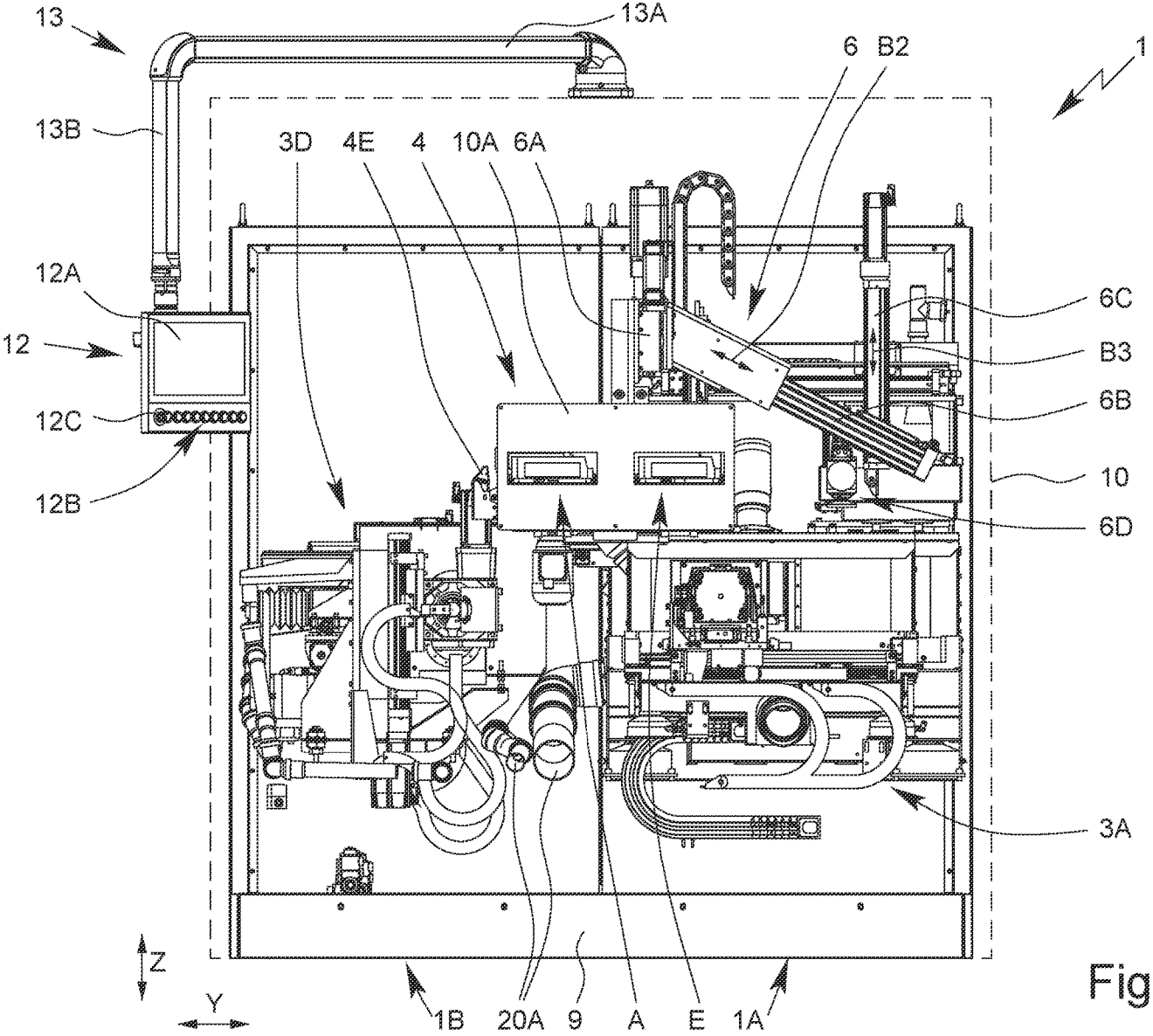
Figure 6:
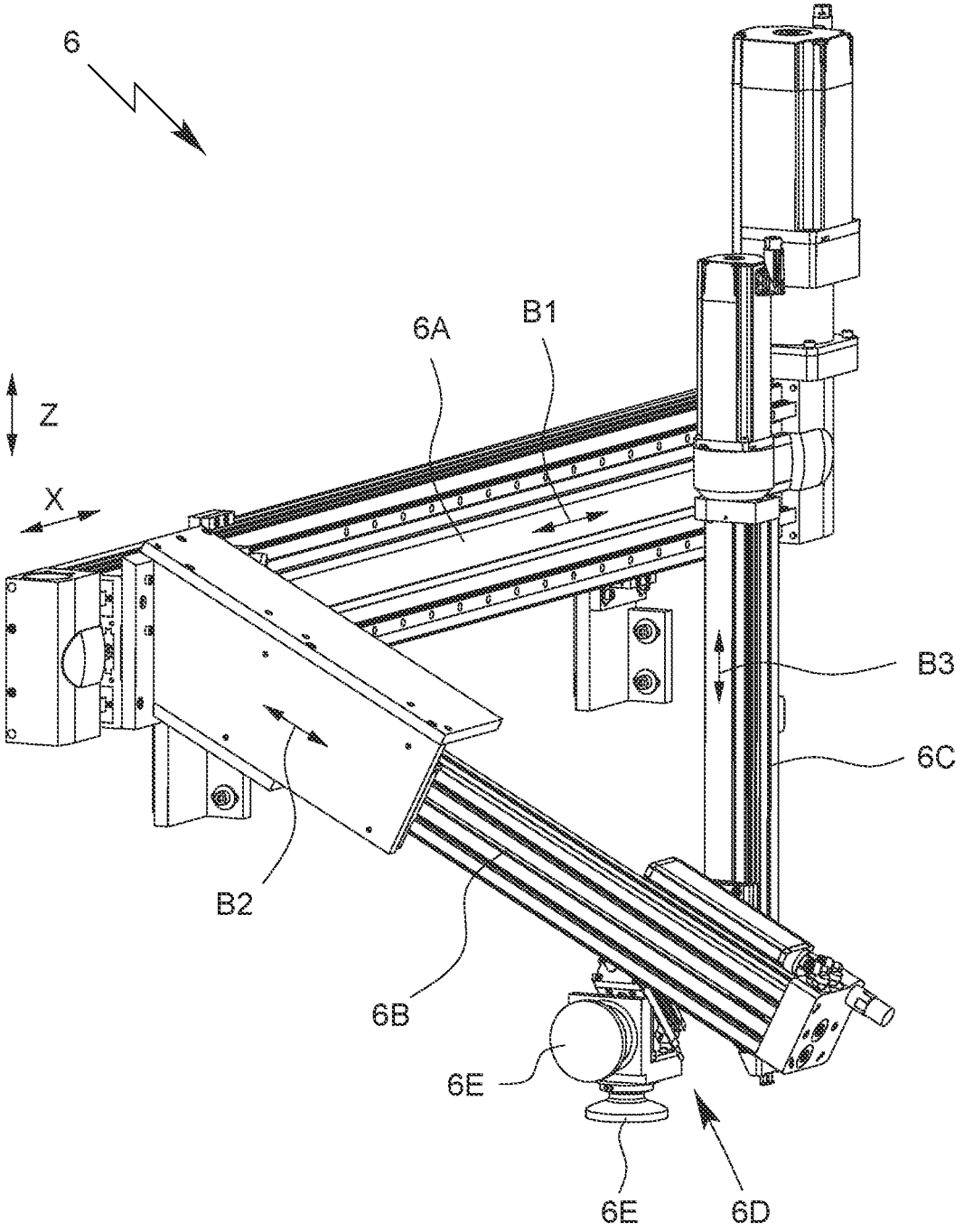
Figure 7:
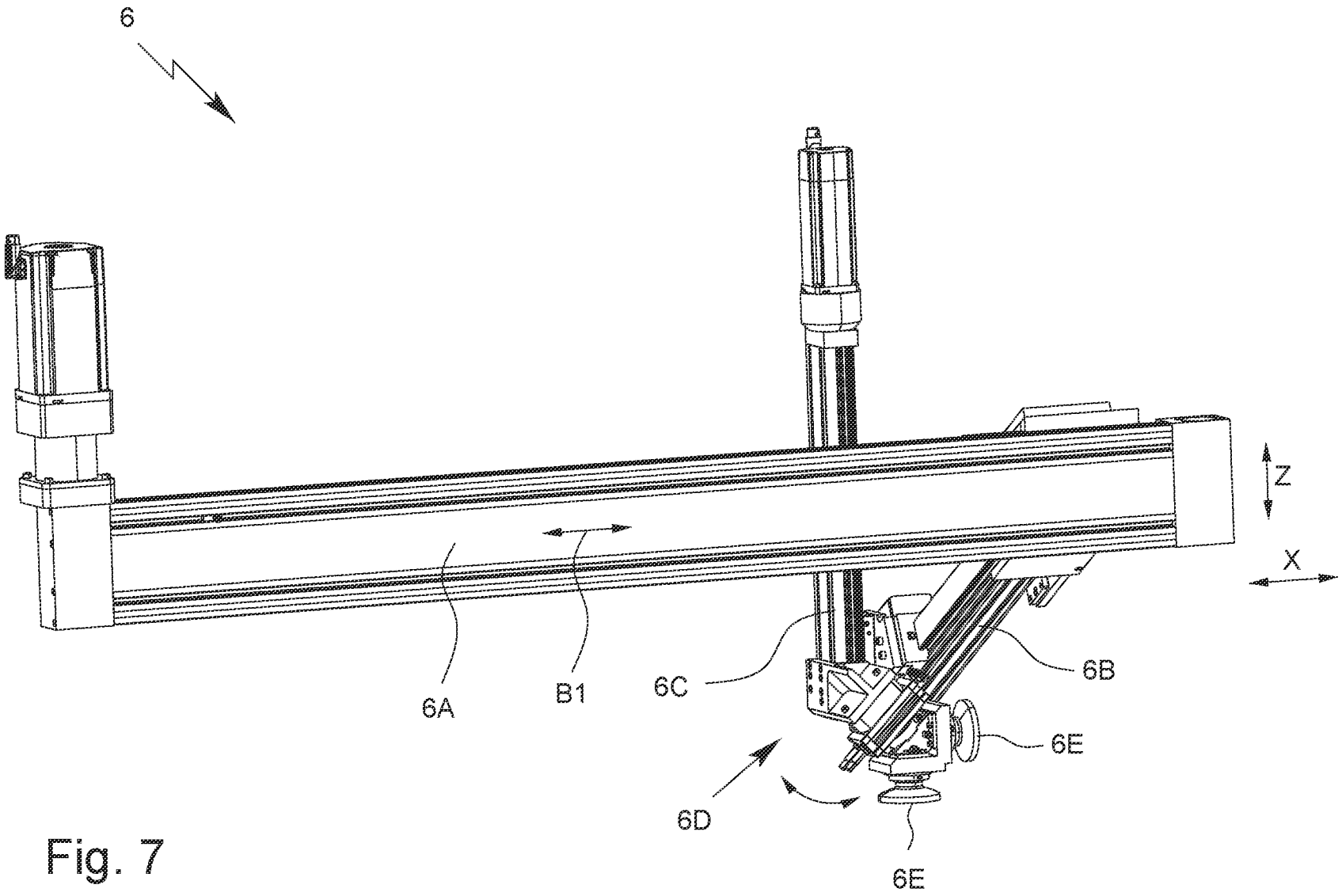
Figure 8:
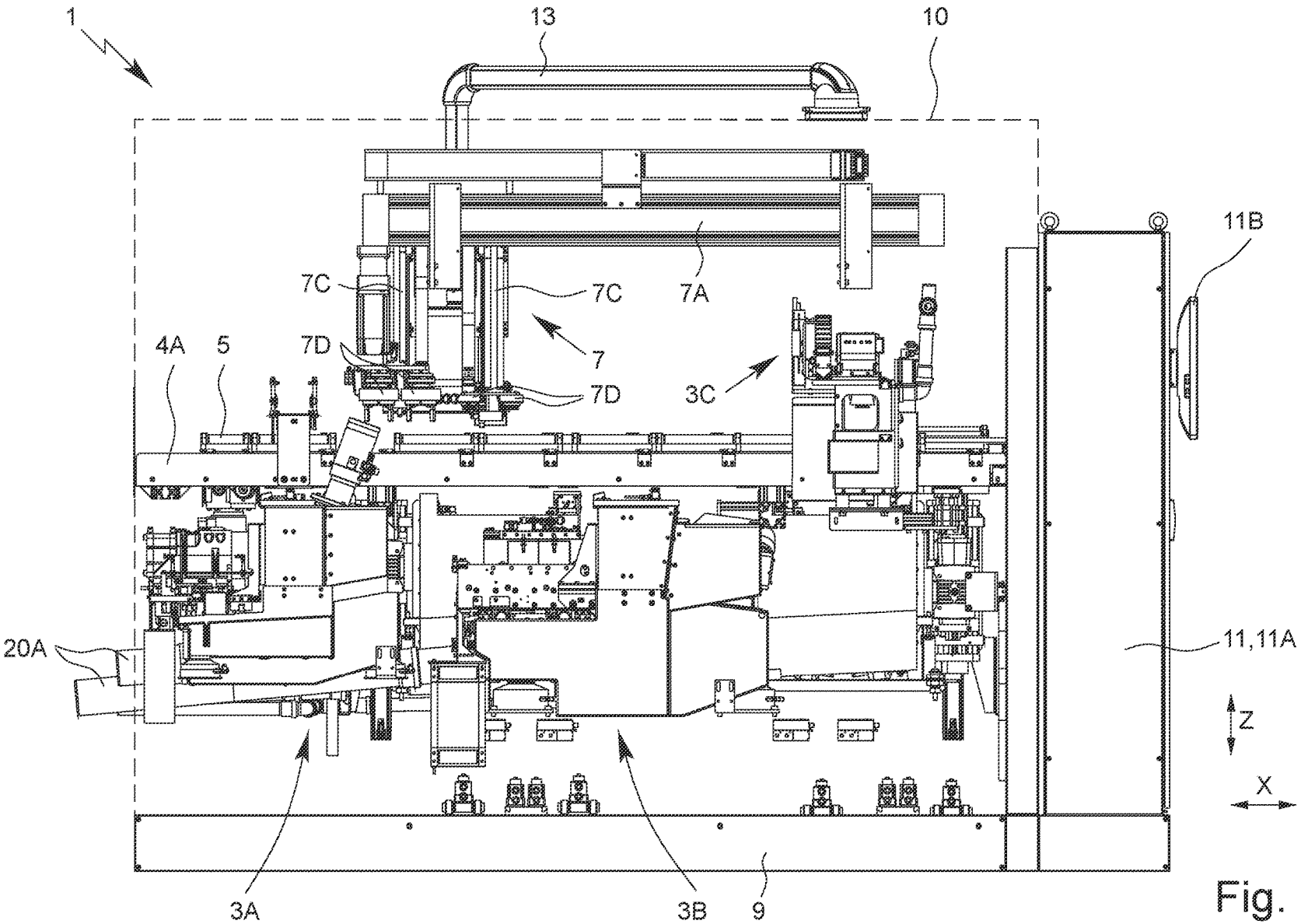
Figure 9:
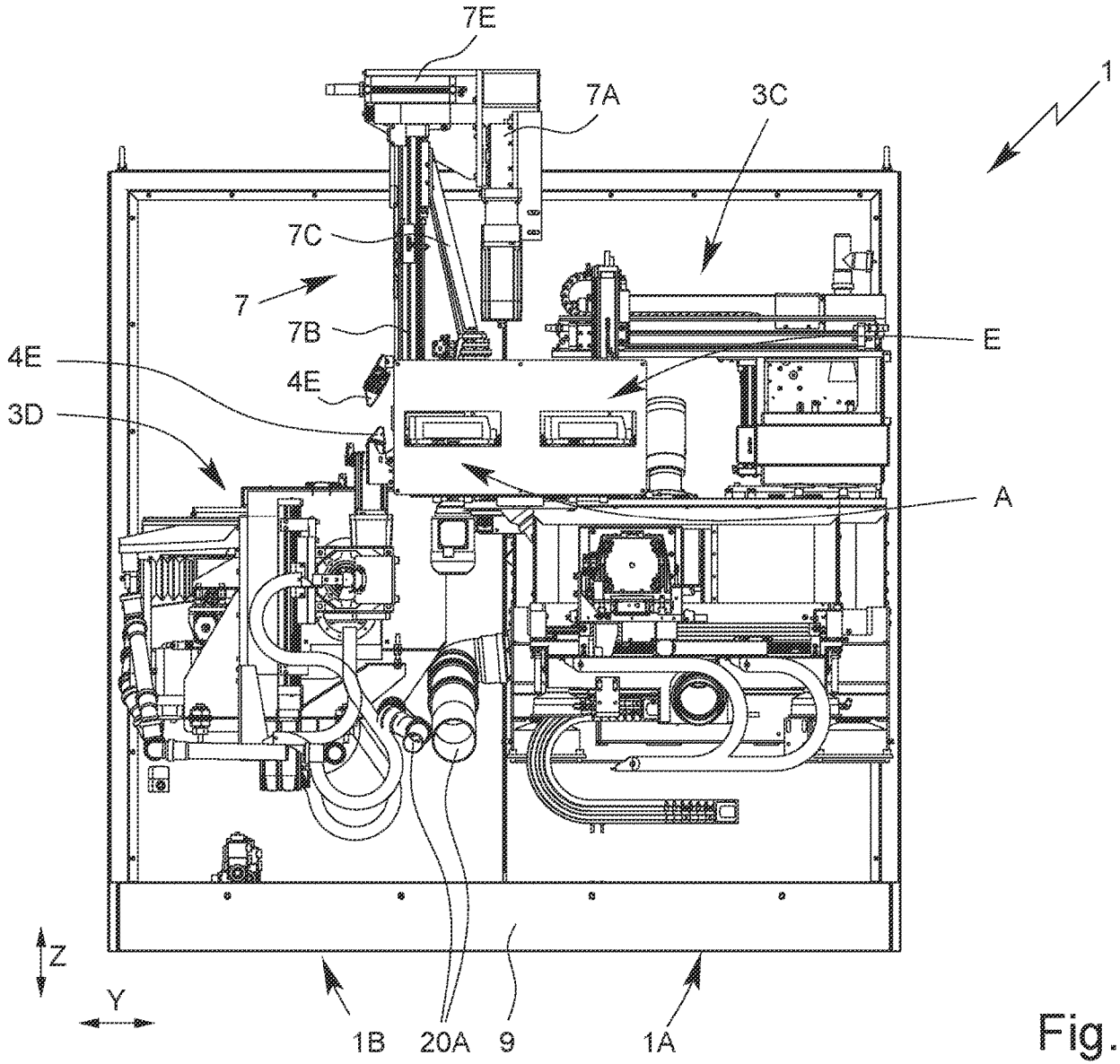
Figure 10:
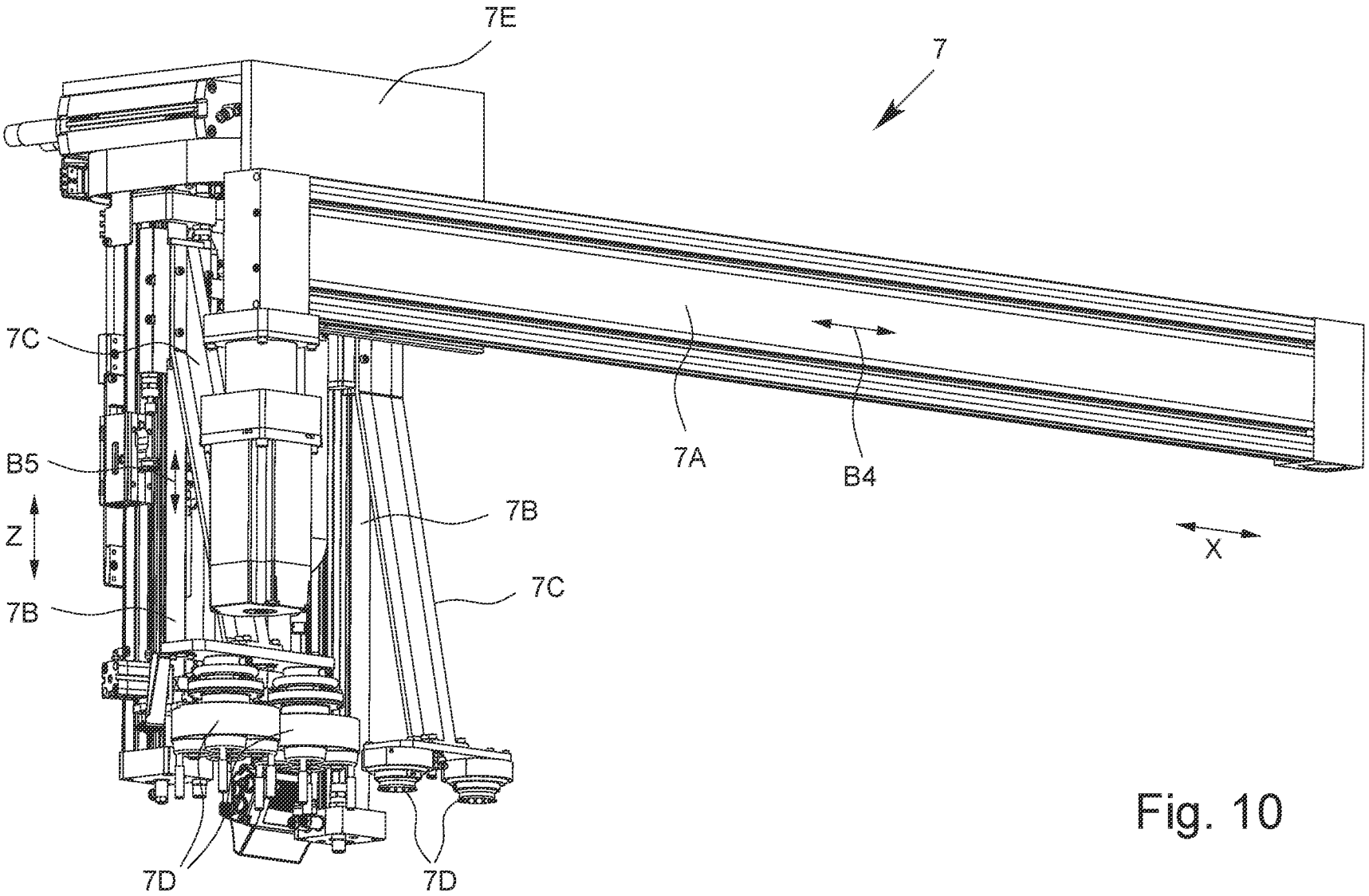
Figure 11:
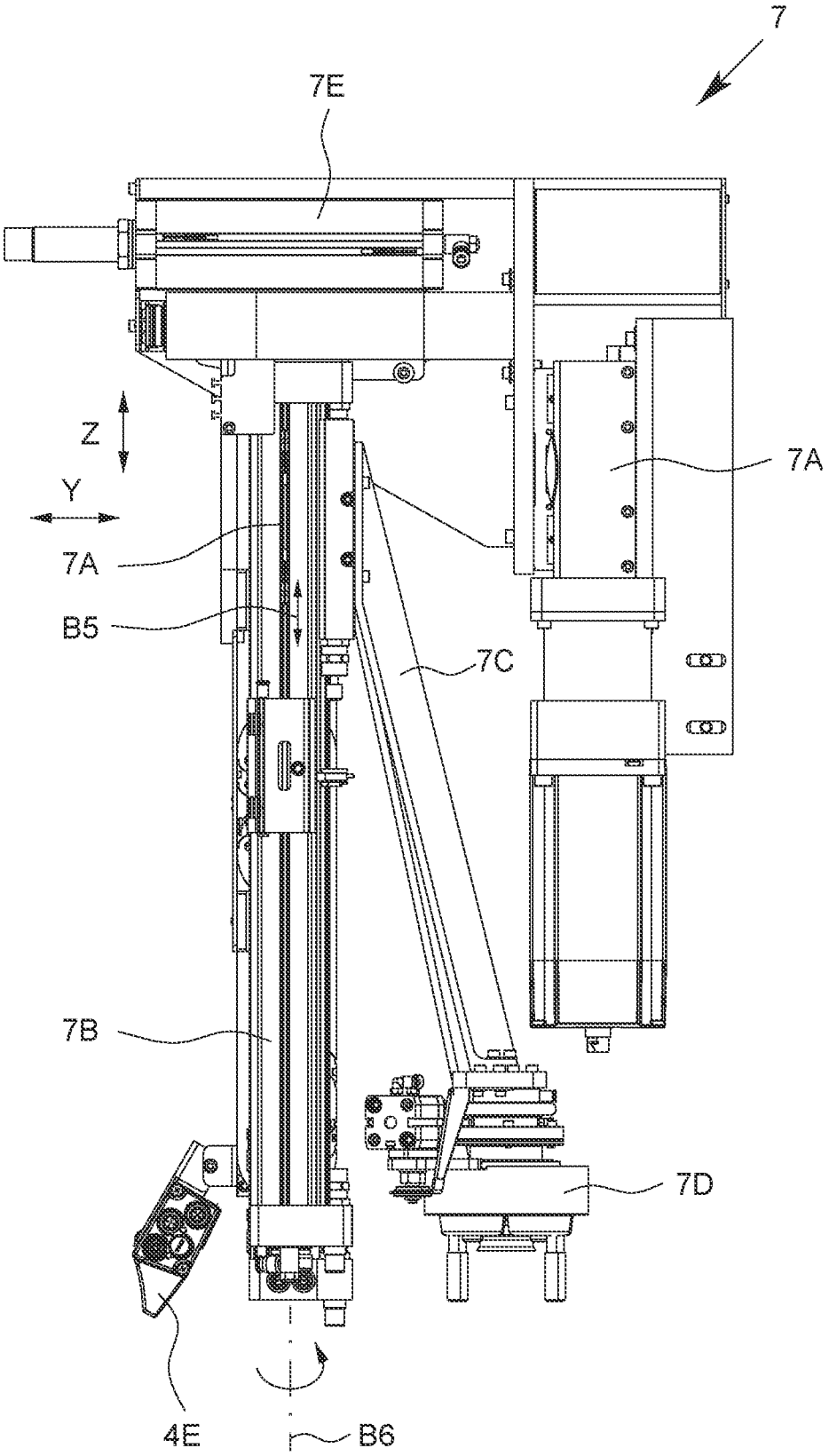
Figure 12:
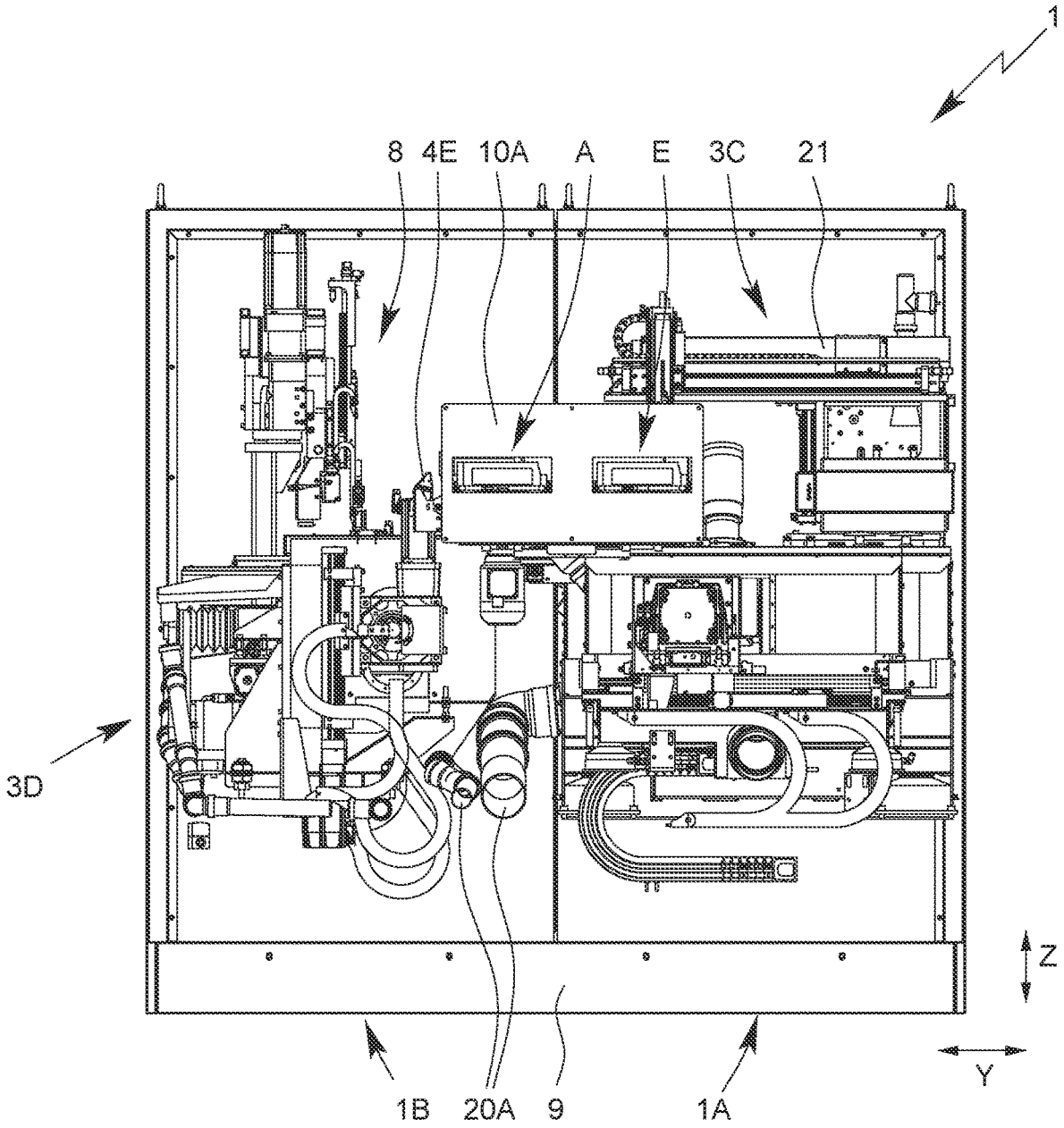
Figure 13:
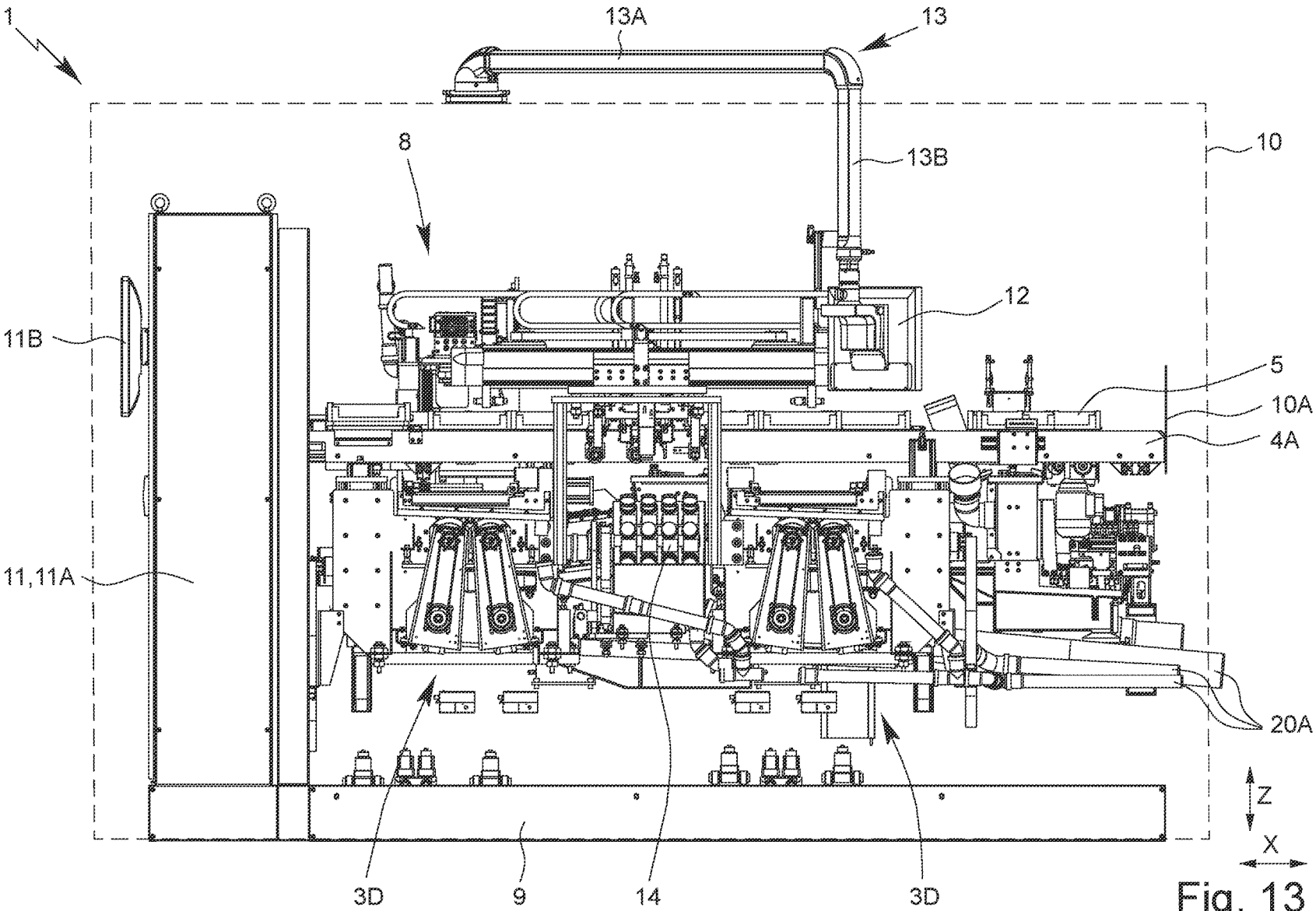
Figure 14:
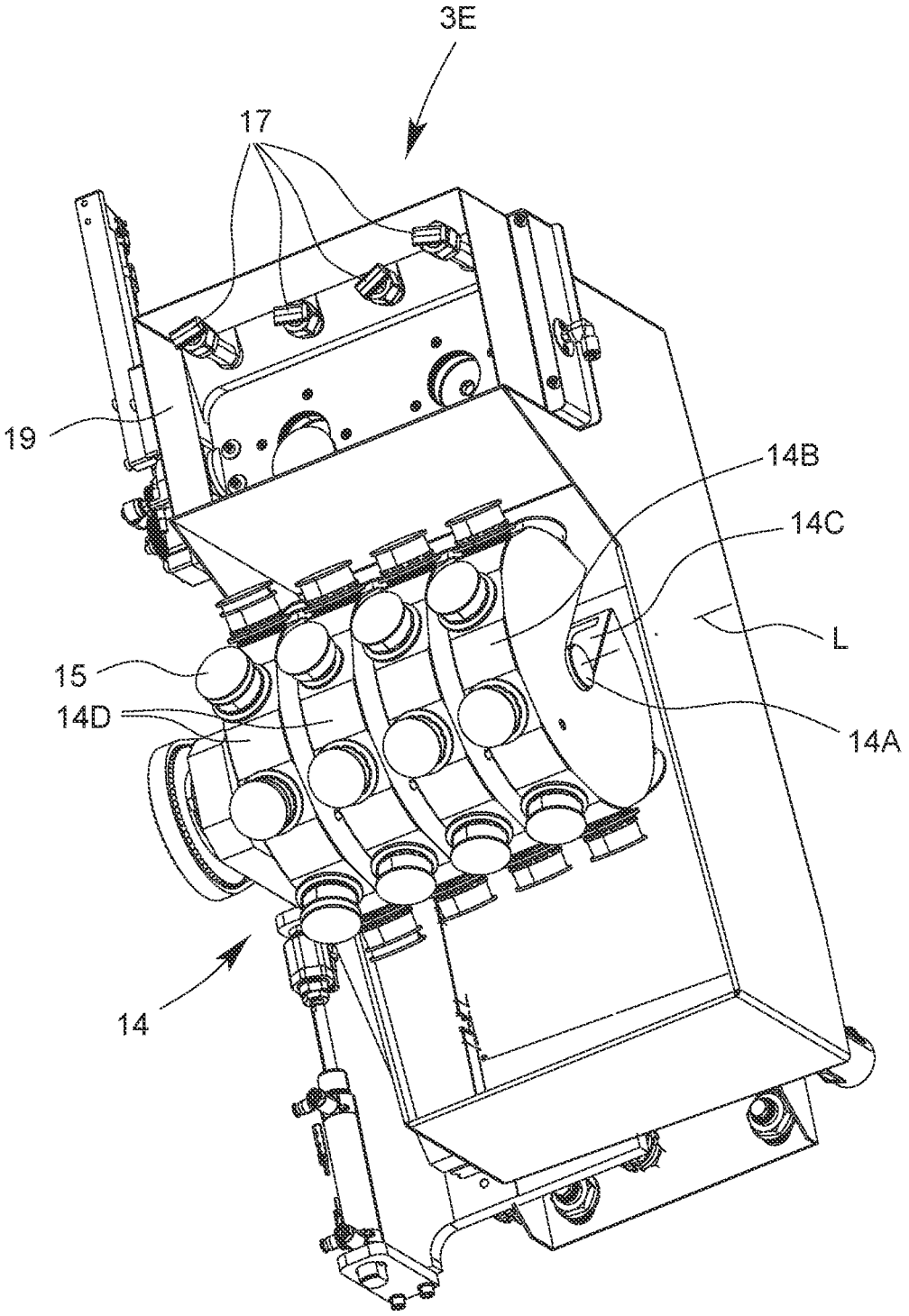
Figure 15:
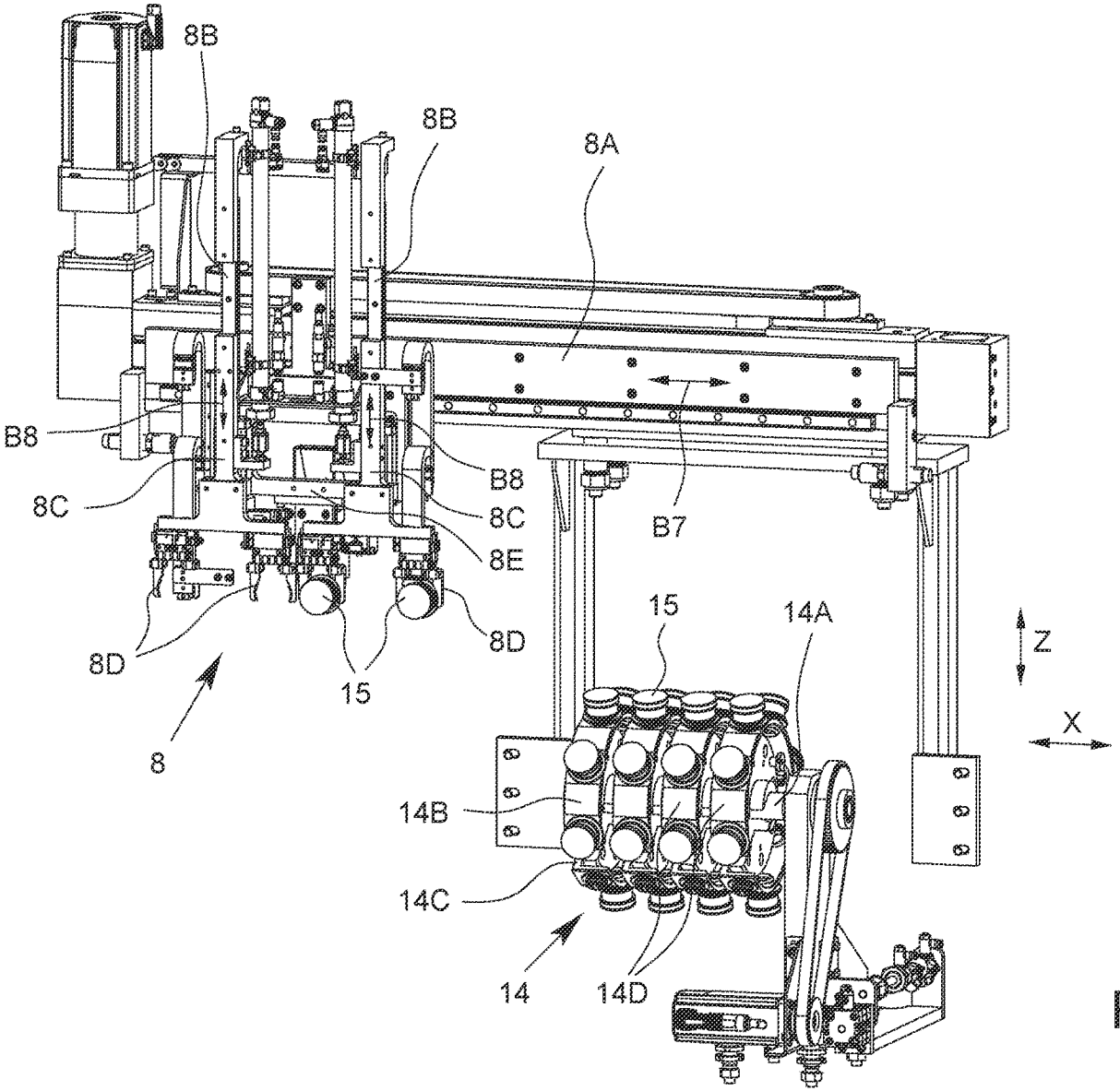
Figure 16:
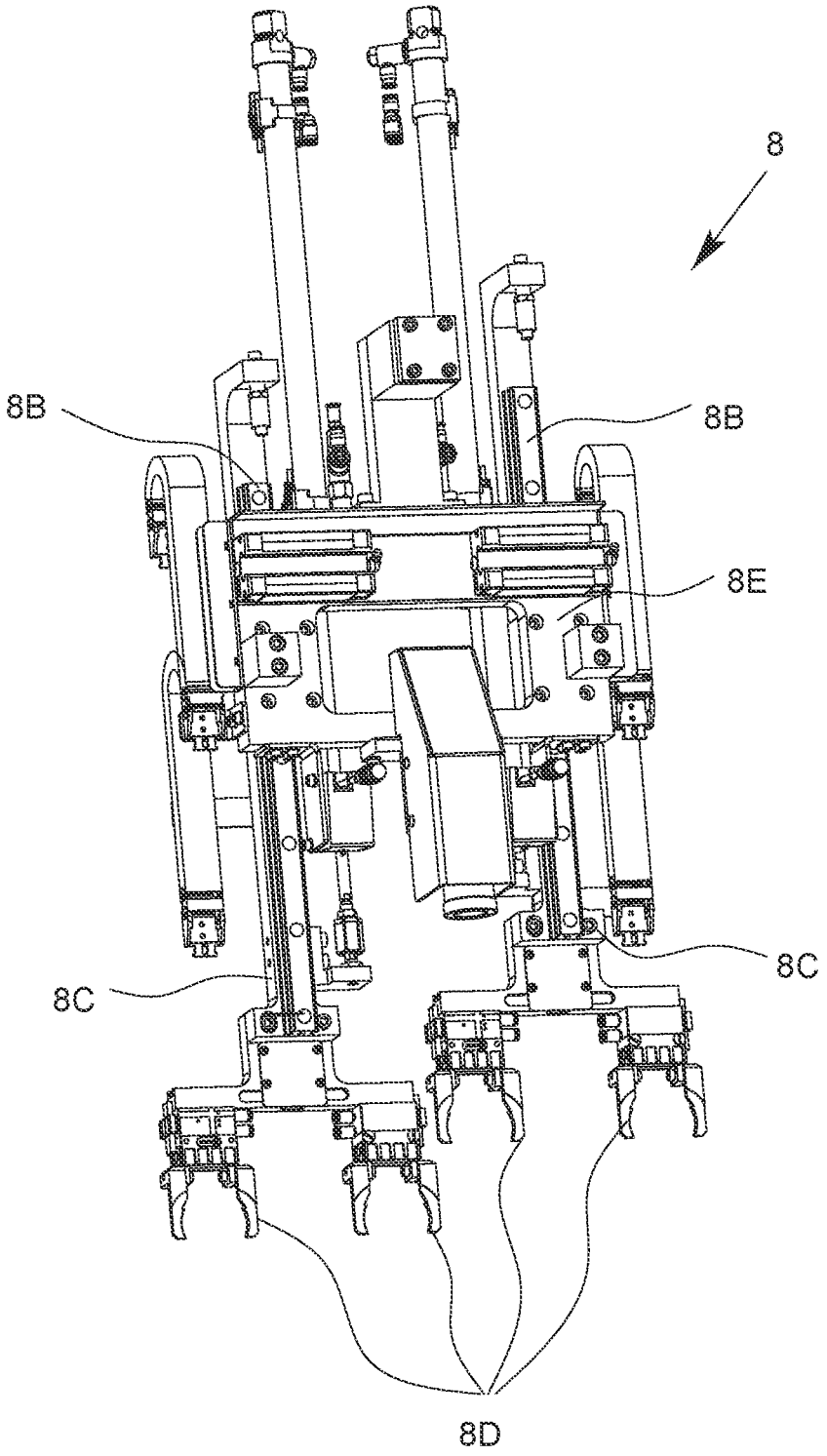

Further advantages, features, characteristics and aspects of the present invention will be apparent from the claims and the following description of a preferred embodiment with reference to the drawing. It shows:

FIG. 1 a schematic top view of a processing system according to the proposal;

FIG. 2 a perspective depiction of the processing system;

FIG. 3 a schematic section of a blocked spectacle lens with a block piece;

FIG. 4 a side view of the processing system with a handling apparatus;

FIG. 5 a front view of the processing system from FIG. 4;

FIG. 6 a perspective depiction of the handling device;

FIG. 7 a perspective rear view of the handling device;

FIG. 8 a modified side view of the processing system with a further handling apparatus;

FIG. 9 a front view of the processing system of FIG. 8;

FIG. 10 a perspective depiction of the further handling device;

FIG. 11 a side view of the further handling device;

FIG. 12 a front view of the processing system with a handling apparatus for tools;

FIG. 13 a modified side view of the processing system from FIG. 12;

FIG. 14 a perspective view of a tool magazine and a cleaning station;

FIG. 15 a perspective view of the tool magazine and the handling apparatus for tools;

FIG. 16 a perspective view of the handling apparatus for tools; and

Figure 17:
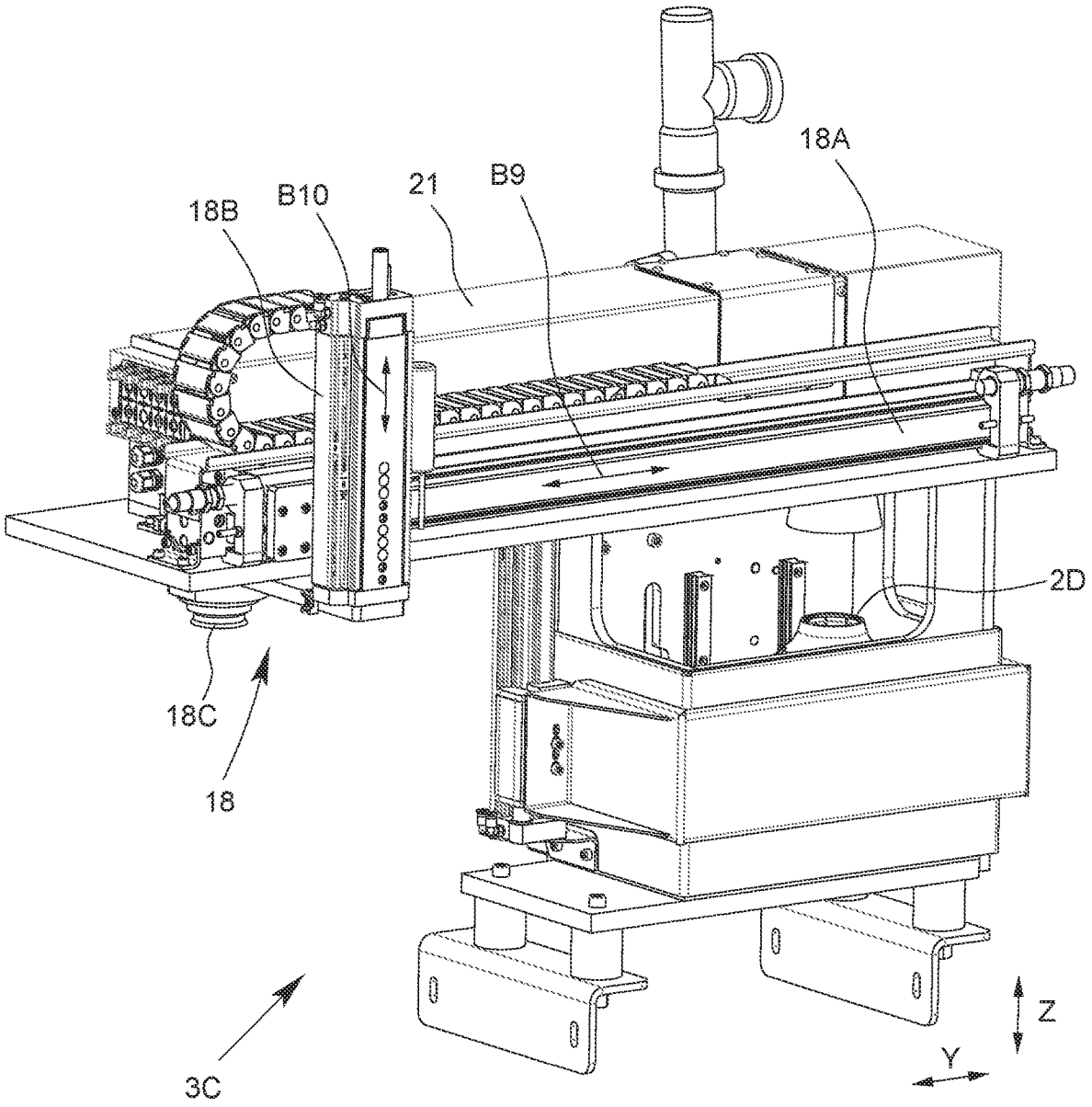

FIG. 17 a perspective view of a signing station.

In the figures, some of which are not to scale and are only schematic, the same reference signs are used for the same or similar parts, wherein corresponding or comparable properties and advantages can be achieved even if a repeated description is omitted.

Overall Concept

FIG. 1 shows a very schematic view of a processing system 1 according to the present invention. FIG. 2 shows the processing system 1 in a simplified perspective view.

The processing system 1 is designed for in particular simultaneous processing of several spectacle lenses 2.

In particular, the processing system 1 enables a high throughput of spectacle lenses 2 with a small footprint, i.e. a small required installation area on the floor.

The footprint or the required installation area of the processing system 1 is preferably at most 20 $m^2$, preferably at most 10 $m^2$, in particular about 2 m×3.2 m.

Preferably, the processing system 1 is designed to (completely) process more than 60 spectacle lenses 2, in particular about 80 or more spectacle lenses 2 per hour. One focus of the processing system 1 is in particular on the lowest possible downtimes or dead times of individual processing stations, a high utilization of individual processing stations and/or the lowest possible dwell time of the spectacle lenses 2 in the processing system 1.

Preferably, the processing system 1 is designed for milling, turning, marking or signing, polishing and/or cleaning or washing and/or drying and optionally for measuring, edge processing or edging and/or coating of spectacle lenses 2. In particular, the milling, turning and polishing refers to the processing of a flat side or optical surface of a spectacle lens 2. The flat side preferably forms an optical surface or optically effective surface of the spectacle lens 2 and is usually not planar, but somewhat curved, for example spherical or toric, as is also indicated in particular in FIG. 3.

The processing system 1 is preferably designed for processing blocked spectacle lenses 2 or spectacle lenses 2 that are attached to a block piece 2A. However, this is not mandatory, the processing system 1 can also be designed for blockless processing of spectacle lenses 2.

FIG. 3 shows a schematic section of a spectacle lens 2 which is blocked, i.e. temporarily fixed, on an associated block piece 2A by means of a block material 2B.

A protective layer 2C may be provided between the block material 2B and the spectacle lens 2, which may be formed, for example, by a coating such as a varnish or film or the like, or by a (for example adhered) foil.

The block piece 2A is designed in particular for clamping with a defined rotational position for machining the associated spectacle lens 2.

Accordingly, the spectacle lens 2 preferably has a "block side" and a "processing side". Usually, the block side, i.e. the side or flat side of the spectacle lens 2 to which the block piece 2A is attached or which faces the block piece 2A, is already fully machined and/or only the (still unprocessed) processing side is processed.

Preferably, the block piece 2A facilitates the handling and alignment of the spectacle lens 2. In the following, the block piece 2A will not be explicitly discussed. In particular, the term "spectacle lens 2" also includes spectacle lenses 2 with block pieces 2A arranged thereon.

In the case of blockless processing, the processing system 1 preferably has a system for detecting the position of the spectacle lenses 2 and/or for aligning the spectacle lenses 2.

This may, for example, comprise one or more measuring devices for determining the orientation and/or alignment devices for aligning the spectacle lenses 2 in a specific orientation and/or for maintaining a specific orientation of the spectacle lenses 2.

In particular, such devices may be associated with one or more handling apparatuses and/or one or more processing stations of the processing system 1.

In the following, when describing the arrangement of different components in relation to each other, reference is made in particular to the axes X, Y and Z indicated by arrows in FIGS. 1 and 2.

The X, Y and Z axes are preferably orthogonal to each other. The X and Y axes are preferably horizontal. The Z axis is preferably vertical or perpendicular.

In the following, the X, Y and Z directions are referred to as directions that run parallel to the X, Y and Z axes. The X direction or X axis preferably runs in the central, longitudinal or main axis of the processing system 1 or parallel thereto.

The processing system 1 preferably has several processing stations 3. In particular, the processing system 1 has at least two processing stations 3 of different type or at least two processing stations 3 for performing different processing operations.

Preferably, the processing system 1 has a milling station 3A, a turning station 3B, a signing station 3C, a polishing station 3D and/or a cleaning station 3E. The stations 3A-E each constitute a processing station 3.

A processing station 3, in particular the milling station 3A, turning station 3B and/or polishing station 3D, preferably has a tool for processing the spectacle lens 2, a workpiece spindle or spindle for the spectacle lens 2 to be processed and/or a tool spindle for the processing tool. In particular, the workpiece spindle has a chuck 2D for the spectacle lens 2 or the block piece 2A, as exemplified in FIG. 17. Furthermore, a processing station 3 preferably comprises a working space for processing spectacle lenses 2, in particular wherein the workpiece spindle and/or tool spindle are arranged in the working space. Different processing stations 3 preferably have different workpiece spindles, tool spindles and/or work spaces.

The turning station 3B is preferably vibration-decoupled, for example by means of an air bearing. However, other solutions are also possible here.

Preferably, the processing system 1 is designed to perform a complete processing or surface processing, also referred to as surfacing, of the spectacle lenses 2. A surface processing is in particular a processing of the optical surface(s) or flat side(s) of a spectacle lens 2. A "complete processing" in the sense of the present invention comprises in particular a milling, turning, polishing and/or cleaning and optionally a signing. Furthermore, a complete processing may optionally comprise a coating and/or an edge processing (edging). However, other solutions are also possible here, in particular not complete or only partial processing in the processing system 1.

In the following, processing stations 3 that perform the same type of processing, for example, each polishing the spectacle lenses 2, are referred to as processing stations 3 "of the same type". In contrast, processing stations 3 that perform different types of machining are referred to as processing stations 3 "of different type". In particular, the milling station 3A, turning station 3B, signing station 3C, polishing station 3D and cleaning station 3E are each processing stations 3 of different type.

The processing system 1 can also have several processing stations 3 of the same type in each case. In the example shown, the processing system 1 preferably has exactly two polishing stations 3D.

Preferably, the spectacle lens 2 is processed in all processing stations 3 of differently type for different processings. The (different) processings in the processing stations of different type preferably build on each other or preferably form a subsequent processing of the spectacle lens 2. In particular, the processing sequence is the same for each lens 2.

If the processing system 1 has several processing stations 3 of the same type or several processing stations 3 for the same processing, the spectacle lens 2 is preferably processed in only one of the processing stations 3 of the same type.

The processing system 1 preferably has a transport system 4 for transporting the spectacle lenses 2 within the processing system 1. Preferably, the spectacle lenses 2 are transported in transport containers 5, which are transported by means of the transport system 4.

The transport containers 5 and/or spectacle lenses 2 are preferably transported (by means of the transport system 4) in the X direction.

The transport system 4 preferably has several, in particular separate, transport devices 4A, in the illustrated example two transport devices 4A.

The transport devices 4A can also be formed by different sections of a common transport system 4, for example forming a continuous conveyor track.

The following explanations on transport devices 4A preferably also apply accordingly to transport sections.

The transport sections or transport devices 4A preferably run in a straight line at least in areas, in pieces or to the greatest possible extent.

The transport devices 4A are preferably designed as roller conveyor or conveyor belt.

The transport devices 4A are preferably arranged parallel to the X-axis and/or to each other or run in the X-direction. The transport system 4 or the transport devices 4A preferably serve to transport the transport containers 5 and/or spectacle lenses 2 along and/or past the processing stations 3.

The processing system 1 preferably has one or more handling apparatuses 6, 7, 8, 18 for handling the spectacle lenses 2 and/or for handling tools 15 for processing the spectacle lenses 2.

The term "handling" of a spectacle lens 2 is understood to mean in particular one or more of the following steps: Removal of the spectacle lens 2 from a transport container 5, transfer of the spectacle lens 2 from the transport container 5 to one or more processing stations 3, handing over of the spectacle lens 2 to the processing station 3, in particular insertion into a spectacle lens holder or a chuck 2D of the processing station 3, removal of the spectacle lens 2 from a processing station 3, in particular direct removal of the spectacle lens 2 from a spectacle lens holder or chuck 2D of the processing station 3, transfer of the spectacle lens 2 between two processing stations 3 and/or handing over of the spectacle lens 2 from a processing station 3 to a further processing station 3 and/or between two processing stations 3 and/or handing over of the spectacle lens 2 to a transport container 5 or depositing of the spectacle lens 2 in a transport container 5. Furthermore, the handling of a spectacle lens 2 can comprise changing a relative position of the spectacle lens 2, for example rotating, tilting, pivoting and/or otherwise aligning the spectacle lens 2.

Handling apparatuses 6-8 are omitted in FIG. 2 for clarity and are shown in detail in further figures.

The handling apparatuses 6-8 are preferably designed for handling spectacle lenses 2 and/or tools 15 independently of the processing in the processing stations 3 and/or independently of the transport of the transport containers 5 by means of the transport system 4. Preferably, the different handling apparatuses 6-8 are independent of each other and/or do not have common movement axes.

Preferably, individual, several or all handling apparatuses 6-8 are assigned to several processing stations 3.

The handling apparatuses 6-8 are preferably designed either for handling spectacle lenses 2 or for handling tools 15. However, it is also possible that one or more of the handling apparatuses 6-8 is/are designed both for handling spectacle lenses 2 and for handling tools 15.

Preferably, the handling apparatuses 6-8 operate independently of each other and/or independently of a processing of the spectacle lenses 2 in the processing stations 3. In particular, spectacle lenses 2 and/or tools 15 are handled by means of one or more of the handling apparatuses 6-8, in particular moved or transferred between different positions, while a spectacle lens 2 is being processed in a processing station 3 (which is assigned to the handling apparatus 6-8). In this way, dead times of the processing stations 3, i.e. periods of time in which no processing of a spectacle lens 2 takes place in a processing station 3, can be minimized. This increases the throughput of the processing stations 3 or the processing system 1.

The handling apparatuses 6-8 are preferably positioned as close as possible to the transport system 4 and/or the respective assigned processing stations 3 in order to realize short handling times and/or short travel distances.

Preferably, some, several or all of the handling apparatuses 6-8, 18 are designed to detect transport containers 5 and/or spectacle lenses 2 and/or to determine or detect the position thereof, for example by means of a detection device 4E described later and/or one or more other or further position detection devices.

The processing system 1 preferably has a base frame 9 which supports the processing stations 3 and/or the transport system 4 or on which the processing stations 3 and/or the transport system 4 are arranged. The base frame 9 preferably comprises or is formed by a metal frame.

The processing system 1 preferably has a housing or casing 10. The processing stations 3 and/or the transport system 4 are preferably arranged within the casing 10 or surrounded by the casing 10. In particular, the casing 10 forms an outer enclosure or boundary of the processing system 1.

The casing 10 may be attached to or connected to the base frame 9. However, it is also possible for the casing 10 to be separate from the base frame 9, for example by being anchored in the ground without contact with the base frame 9.

In FIGS. 4 and 8, different embodiments of the casing 10 are indicated. In particular, it is possible that parts of the processing system 1 are arranged outside the casing 10. In the example shown in FIG. 8, the switch cabinet 11A is arranged outside the casing 10.

The casing 10 preferably has a plurality of access points, such as openings, flaps, doors, windows and/or other devices, which allow access to the space surrounded or limited by the casing 10. In particular, this allows access to individual processing stations 3, to the transport system 4 and/or to the switch cabinet 11A, for example for inspection, maintenance, servicing and/or repair. The accesses are preferably openable and/or closable.

In particular, in embodiments deviating from the illustrative example, access to parts of the processing system 1 other than the processing stations 3 can also be enabled through accesses of the casing 10. For example, the transport system 4 can be arranged in the vicinity of the casing 10 in such a way that direct access to the transport system 4 is possible through accesses of the casing, e.g. if the transport system 4 is arranged at the outer edge of the processing system 1 or at least partially in the vicinity of the casing and/or has only one transport device 4A.

The processing system 1 preferably has an integrated or common control system for the processing stations 3, the transport system 4 and/or the handling apparatuses 6-8.

The control system is preferably arranged or accommodated in one or more switch cabinets 11A. The control system or the switch cabinet 11A is preferably arranged on a front face of the processing system 1, the transport system 4 and/or the casing 10 and/or on a transverse side of the base frame 9 or on or at the base frame 9.

The switch cabinet 11A may be movable so that access to the processing system 1 or parts thereof, such as the transport system 4 and/or one or more processing stations 3, is enabled or facilitated, for example by moving, rotating, folding or pivoting the switch cabinet 11A.

The control system may comprise or be formed by one or more separate or independently operating control devices 11 for controlling one or more components of the processing system 1. This will be discussed in more detail later.

The processing system 1 preferably has an operating apparatus 12. The operating apparatus 12 preferably has a display device 12A and/or an input device 12B. The display device 12A and input device 12B can in particular also be formed by the same element, for example a touch screen or a touch-sensitive display.

The operating apparatus 12 can preferably be used to control or operate different processing stations 3 of the processing system 1 individually or independently of one another. This will be discussed in more detail later.

It is advantageous if the operating apparatus 12 is arranged on an arm 13, in particular at the end thereof.

The processing system 1 or the arm 13 is preferably designed in such a way that the operating apparatus 12 can be used flexibly or can be positioned around the processing system 1 or optionally on different sides or in front of different processing stations 3. This will be discussed in more detail later.

The processing system 1 preferably has a tool magazine 14. The tool magazine 14 can be assigned to one or more processing stations 3 or have or stock tools 15 for one or more processing stations 3.

Particularly preferably, the tool magazine 14 is assigned to one or two polishing stations 3D and/or arranged between two polishing stations 3D. In this case, the tools 15 are in particular polishing tools or polishing heads.

In principle, however, the processing system 1 can also have one or more tool magazines 14 for other tools 15, for example milling and/or turning tools.

Preferably, the cleaning station 3E is associated with one or more polishing stations 3D and/or is designed for cleaning spectacle lenses 2 and/or tools 15, in particular polishing tools.

The cleaning station 3E is preferably arranged next to one or more polishing stations 3D, in particular between two polishing stations 3D.

The cleaning station 3E is preferably designed for washing and/or drying spectacle lenses 2 and/or tools 15. This will be discussed in more detail later.

Preferably, the tool magazine 14 and the cleaning station 3E form a common unit or the tool magazine 14 is integrated into the cleaning station 3E.

The processing system 1 preferably has a supply system 20 for supplying one or more processing stations 3 with operating fluids. The arrangement or position of the supply system 20 is schematically indicated in FIG. 1. The supply system 20 is not shown in the further figures.

The supply system 20 is preferably located near the entrance E and/or exit A, near the polishing station 3D, on the polishing side 1B and/or on the side of the processing system 1 opposite the switch cabinet 11A.

Preferably, the supply system 20 is arranged laterally offset from the transport system 4 and/or at least partially below the transport system 4.

In particular, the supply system 20 has reservoirs for different operating fluids of the processing stations 3, in particular the polishing stations 3D, for example coolant, polishing agent, cleaning fluid or the like.

The supply system 20 preferably has one or more lines 20A for supplying operating fluids to the processing stations 3 and/or for discharging (used or consumed) operating fluids or waste, waste water or the like from the processing stations 3. Accordingly, the supply system 20 may also have collection containers for operating fluids, waste, waste water or the like discharged from the processing stations.

The transport system 4 or the processing system 1 is preferably connected to an external transfer system 16 or a transfer system 16 separate from the processing system 1, via which the spectacle lenses 2 or transport containers 5 with the spectacle lenses 2 are or can be conveyed to the processing system 1 or transport system 4 and/or are or can be conveyed away from the processing system 1.

Divisibility

The base frame 9 preferably has several, in particular two, subframes 9A, each of which forms a base frame for one or more processing stations 3 and in particular a transport device 4A. The subframes 9A can preferably be connected to each other to form the base frame 9 or can be fastened to each other.

In particular, the subframes 9A can be connected to each other on site, i.e. at the assembly location of the processing system 1, easily or with little effort and/or in a short time to form the base frame 9.

According to a preferred aspect, the processing system 1 is divisible into two parts 1A, 1B or is or can be assembled from two parts 1A, 1B.

Optionally, each of the two parts 1A, 1B is functional separately and/or independently of the respective other part 1A, 1B. In particular, the parts 1A, 1B are then each designed in such a way that they form an independently functional processing system 1 for the same or different machining operations.

In the illustrative example, the processing system 1 is divided into two parts 1A, 1B, preferably a processing side 1A and a polishing side 1B.

Preferably, the two sides or parts 1A, 1B of the processing system 1 each form a ready-assembled unit with a transport device 4A, one or more processing stations 3, one or more handling apparatuses 6-8 and/or a control system or switch cabinet 11A. In particular, the processing side 1A has the milling station 3A and the turning station 3B and optionally the signing station 3C. However, the signing station 3C can also be integrated into the polishing side 1B. In the example shown, the polishing side 1B has two preferably identically designed polishing stations 3D. Furthermore, the polishing side 1B preferably has the tool magazine 14 and/or the cleaning station 3E.

The processing side 1A may form a processing system 1 for milling, turning and/or signing spectacle lenses 2.

The polishing side 1B may form a processing system 1 for polishing, cleaning and/or signing spectacle lenses 2.

Preferred Procedure

Preferably, a method for processing spectacle lenses 2 comprises one or more of the following steps. In particular, the processing system 1 is designed to perform these steps.

The method is described below primarily with reference to a single spectacle lens 2. Preferably, in the method, several spectacle lenses 2 are processed simultaneously in different processing stations 3. Preferably, different spectacle lenses 2 pass through the same processing stations 3 and/or all spectacle lenses 2 pass through the processing stations 3 in the same order.

The steps explained below are intended to provide an overview of the method. The method may in particular have further steps which will be described later. In particular, the processing system 1 is also designed to perform these further steps.

Preferably, the spectacle lens 2 is first handed over or conveyed to the processing system 1 or transport system 4, in particular by means of the external transfer system 16 and/or in transport containers 5.

Preferably, several lenses 2 are processed and/or transported and/or handled simultaneously.

The spectacle lens 2 is preferably processed successively in several, in particular different, processing stations 3. Preferably, a transport of the transport container 5 assigned to the spectacle lens 2 by the transport system 4 and a handling of the spectacle lens 2 by one or more handling apparatuses 6, 7 take place in parallel or simultaneously.

The spectacle lens 2 is preferably first processed or milled in the milling station 3A. For this purpose, the transport container 5 with the spectacle lens 2 is preferably transported in front of the milling station 3A by means of the transport system 4 and the spectacle lens 2 is removed from the transport container 5 by means of the handling apparatus 6 and handed over to the milling station 3A.

After processing in the milling station 3A or milling, the spectacle lens 2 is preferably removed from the milling station 3A with the same handling apparatus 6 and transferred to a further processing station 3, in particular to the turning station 3B. Subsequently, a turning of the spectacle lens 2 preferably takes place in the turning station 3B. After the turning, the spectacle lens 2 is removed from the turning station 3B, preferably with the same handling apparatus 6. In particular, the spectacle lens 2 is not transferred back to the transport system 4 or not deposited in the transport container 5 between the milling and the turning.

Subsequently, the spectacle lens 2 is preferably deposited again, in particular by means of the same handling apparatus 6, in a transport container 5, particularly preferably in the same transport container 5 from which it was previously removed.

The transport container 5 was preferably transported further in the meantime or transported from the milling station 3A to or in front of the turning station 3B. The further transport preferably takes place during the processing of the spectacle lens 2 and/or the handling of the spectacle lens 2 by means of the handling apparatus 6.

It is preferred if several spectacle lenses 2 are handled simultaneously by means of the handling apparatus 6. In particular, it is preferred if the handling apparatus 6, during the processing of a first spectacle lens 2 in the milling station 3A, already removes a further spectacle lens 2 from the same or a further transport container 5 and preferably already holds or stocks it for subsequent processing in the milling station 3A. When the processing of the first spectacle lens 2 in the milling station 3A is completed, the handling apparatus 6 can then remove this spectacle lens 2 from the milling station 3A and immediately thereafter transfer the stocked, not yet milled further spectacle lens 2 to the processing station 3 or milling station 3A.

Preferably, the first fully milled spectacle lens 2 is then handed over to the turning station 3B as described. It is also possible that after the first spectacle lens 2 has been milled, it is first handed over to the turning station 3B and only then the (already stocked) further lens 2 is handed over to the milling station 3A.

If a spectacle lens 2 is already being processed in the turning station 3B, it is preferable to wait until the processing is finished to first remove the spectacle lens 2 from the turning station 3B and only then transfer the next spectacle lens 2 to the turning station 3B.

Turning and/or milling is preferably performed as described in DE 10 2005 057 725 A1.

Preferably, a spectacle lens holder or workpiece spindle of the milling station 3A and/or turning station 3B is aligned horizontally and/or the spectacle lens 2 is rotated about a horizontally extending rotation axis during turning or milling.

Preferably, marking or signing of the spectacle lens 2 is carried out after the milling and/or turning of the spectacle lens 2. However, marking or signing can also be carried out at a later time, in particular after polishing of the spectacle lens 2.

The transport container 5 with the spectacle lens 2 is preferably transported further after the turning of the spectacle lens 2, in particular transported to the signing station 3C.

Preferably, the spectacle lens 2 is removed from the transport container 5 by means of a handling apparatus 18 of the signing station 3C, then signed or marked, in particular with a laser 21 or laser beam, and handed over back to the transport container 5 or deposited therein.

Preferably, the transport container 5 with the spectacle lens 2 is subsequently transported further and/or transferred from the processing side 1A to the polishing side 1B. In particular, the transport container 5 is transferred to a further or the second transport device 4A of the transport system 4, preferably with a changing device 4B arranged in particular at the end of the transport system 4 or the first transport device 4A.

Preferably, the spectacle lens 2 is polished as a further or next processing step. For this purpose, the processing system 1 preferably has two polishing stations 3D, in particular of the same type or identical design. This can increase the throughput of the processing system 1, since the polishing process usually takes considerably longer than the turning and/or milling of the spectacle lens 2.

The processing system 1 preferably has a further handling apparatus 7 and/or one that is separate from and/or operates independently of the aforementioned handling apparatus 6 for handling spectacle lenses 2. The handling apparatus 7 is preferably assigned to several processing stations 3, in particular the two polishing stations 3D.

Preferably, the handling apparatus 7 removes the spectacle lens 2 from the transport container 5 and hands it over to one of the polishing stations 3D. The spectacle lens 2 is preferably processed or polished in only one of the two polishing stations 3D.

Preferably, the polishing station 3D or each of the polishing stations 3D is designed for simultaneous or parallel polishing of two spectacle lenses 2.

The handling apparatus 7 is preferably designed for handling two spectacle lenses 2 simultaneously or in pairs. Preferably, the handling apparatus 7 is used to remove two spectacle lenses 2 simultaneously or in pairs from the transport container 5 and/or hand them over to the polishing station 3D. Preferably, by means of the handling apparatus 7, two spectacle lenses 2 are removed simultaneously or in pairs from the polishing station 3D and/or handed over to the transport container 5.

Preferably, by means of the handling apparatus 7, two spectacle lenses 2 to be polished are removed simultaneously from the transport container 5, then two already polished spectacle lenses 2 are removed from the polishing station 3D and immediately thereafter the two spectacle lenses 2 still to be polished are transferred to the polishing station 3D and only then the two already polished spectacle lenses 2 are deposited again in a or the original transport container 5.

Preferably, the handling apparatus 7 moves, in particular parallel to the transport system 4, while a processing of spectacle lenses 2 takes place in a polishing station 3D. In particular, spectacle lenses 2 are transferred to and/or removed from one of the polishing stations 3D, while further spectacle lenses 2 are polished in the other polishing station 3D.

Preferably, a change of polishing tools takes place simultaneously with the handing over and/or removal or a change of the spectacle lenses 2 in the polishing station 3D. The handling apparatus 8 is preferably provided for changing the polishing tools.

Preferably, polishing is performed as described in US 2014/0038494 A1 or the polishing station 3D is designed as set forth in this paper.

After polishing, the spectacle lenses 2 are preferably cleaned, in particular washed and/or dried. This is done in particular while further spectacle lenses 2 are being polished in the polishing station(s) 3D.

The previously described signing of the spectacle lenses 2 can also be carried out after the polishing and/or cleaning of the spectacle lenses 2.

Preferably, the transport containers 5 or spectacle lenses 2 are finally transferred back to the external transfer system 16.

In summary, in the processing system 1 preferably several spectacle lenses 2 are processed simultaneously in different processing stations 3, in particular milled, processed by turning, signed and polished, preferably in one of several polishing stations 3D. Preferably, the transport of the transport containers 5 is performed by the transport system 4, while the spectacle lenses 2 are handled by means of a plurality of handling apparatuses 6, 7, 18 and/or processed in the processing stations 3.

Transport System

Preferably, the transport system 4 is arranged at least substantially in the center or central axis of the processing system 1 and/or the processing stations 3 or at least parts thereof are arranged on different, in particular mutually remote, sides of the transport system 4.

The transport devices 4A are preferably arranged directly adjacent to each other, in particular next to each other.

The processing stations 3 preferably form two rows, in particular with the transport system 4 and in particular the two transport devices 4A being arranged between the rows. According to another embodiment, however, it can also be provided that the processing stations 3 are arranged between the transport devices 4A and/or the transport devices 4A are each arranged at the edge of the processing system 1.

Preferably, each of the parts 1A, 1B has a transport device 4A.

The processing stations 3 are preferably arranged at least partially laterally of and/or below the transport system 4.

Preferably, the transport devices 4A are at least substantially of the same type or identical in design. The explanations with respect to one of the transport devices 4A preferably also apply to the other transport device 4A.

As already mentioned at the beginning, the transport devices 4A can also be formed merely by different sections of a transport system 4.

The transport devices 4A are preferably designed as linear conveyors, particularly preferably as conveyor belts, and/or are arranged parallel to each other.

The transport system 4 or the transport devices 4 can be clocked.

The transport devices 4A preferably have opposite or antiparallel transport directions R1, R2. The transport directions R1 and/or R2 preferably run parallel to the X axis and/or horizontally.

It is also possible that one or more transport devices 4A have multiple transport directions or are designed to transport containers 5 or spectacle lenses 2 in opposite directions or back and forth.

The transport containers 5 are preferably designed as boxes. In particular, the box is open on the upper side so that handling of the spectacle lenses 2 from above is made possible.

Preferably, each transport container 5 is assigned to a spectacle lens 2 or a pair of spectacle lenses 2 or vice versa. After processing in a processing station 3, the spectacle lenses 2 are preferably deposited again in the same transport container 5 from which they were previously removed for processing.

Preferably, the transport containers 5 have an identifier for the transport container 5 or the spectacle lenses 2 transported with the transport container 5. The identifier can be designed as a barcode or RFID chip, for example.

Alternatively or additionally, the spectacle lenses 2 and/or block pieces 2A may each be provided with an identifier.

Preferably, the identifier can be used to retrieve information about the spectacle lenses 2 or about the processing of the spectacle lenses 2 and/or the identifier has such information.

The processing system 1 or transport system 4 preferably has one or more readers or detection devices 4E for detecting, in particular reading out, the identifiers, in particular of the transport containers 5. The detection devices 4E are preferably arranged laterally on the transport devices 4A, in particular laterally on a transport belt or conveyor belt.

Alternatively or additionally, one or more of the handling apparatuses 6, 7, 18 have a detection device 4E. In the example shown, the handling apparatus 7 for spectacle lenses 2 of the polishing side 1B in particular has a detection device 4E.

The processing system 1 or transport system 4 preferably has a pick-up and a delivery or an entrance E and an exit A for spectacle lenses 2 or transport containers 5.

The term "entrance" refers in particular to the point at which the spectacle lenses 2 or transport containers 5 enter the processing system 1 or are handed over (by the external transfer system 16) to the processing system 1. Correspondingly, the term "exit" designates the point at which the spectacle lenses 2 or transport containers 5 leave the processing system 1 or transport system 4 again and/or are handed over to the external transfer system 16.

The entrance E and exit A of the processing system 1 or transport system 4 are preferably arranged directly adjacent to each other or next to each other and/or on the same side of the processing system 1.

Preferably, the processing system 1 or transport system has a plate 10A, which is arranged at the entrance E and/or exit A or forms the entrance E and/or exit A. Preferably, the plate 10A has two openings through which the spectacle lenses 2 or transport containers 5 enter or leave the processing system 1 or transport system 4.

In particular, the plate 10A may form a part of the casing 10. However, it is also possible that the plate 10A is arranged within the casing 10.

In particular, the transport system 4 is designed in such a way that the transport containers 5 or spectacle lenses 2 enter and leave the processing system 1 on the same side of the processing system 1 or do not completely pass through the processing system 1 in one direction or along one axis.

The transport system 4 preferably has a changing device 4B by means of which the spectacle lenses 2 or transport containers 5 can change between transport devices 4A or can change or be transported from one transport device 4A to another transport device 4A. Preferably, the changing device 4B is arranged in an end region of the transport system 4 or transport devices 4A and/or adjacent to or shortly before the switch cabinets 11A. In particular, the changing device 4B is arranged at the end of the transport system 4 or the transport device 4A and/or opposite the entrance E and/or exit A.

Preferably, the changing device 4B has a transport direction R3 or the transport containers 5 are conveyed by means of the changing device 4B in the transport direction R3. The transport direction R3 preferably runs transversely, in particular perpendicularly, to the first and/or second transport direction R1, R2. Preferably, the transport direction R3 runs in the Y-direction.

The changing device 4B is preferably designed for transverse transport of the transport containers 5 or spectacle lenses 2.

The changing device 4B can also be designed to rotate the transport containers 5. For this purpose, the changing device 4B can, for example, have two cam elements, so that a U-shaped transport system 4 is formed by the transport devices 4A and the changing device 4B. However, the changing device 4B can alternatively or additionally be designed to turn the transport containers 5 on the spot and/or to rotate them about a rotation axis.

Furthermore, the changing device 4B can also be formed by or have a robot arm or the like, wherein the robot arm is designed to grip a transport container 5 and/or spectacle lenses 2 and transfer them from one transport device 4A to the other transport device 4A. If necessary, the transport container 5 can also be rotated during this.

By rotating the transport containers 5 by means of the changing device 4B, the relative orientation of the transport containers 5 with respect to the respective local transport direction R1, R2, R3 is maintained.

In particular, the spectacle lenses 2 or transport containers 5 are first handed over to the first transport device 4A at the entrance E, transported within the processing system 1 in the first transport direction R1, preferably in a straight line or linearly, handed over to the other or second transport device 4A by means of the changing device 4B, transported in the second transport direction R2, opposite to the first transport direction R1, by means of the further transport device 4A and, preferably at the exit A, finally handed over back to the external transfer system 16 or another device.

According to one variant, one or more further changing devices 4B can also be provided, in particular in the area of the entrance E and/or exit A and/or on the side of the transport system 4 opposite the first changing device 4B, but also at any other positions.

The transport system 4 can also have more than two and/or one or more further transport devices 4A, in particular in order to enable a circulation of spectacle lenses 2 and/or transport containers 5 and/or an overtaking of spectacle lenses 2 and/or transport containers 5. The further transport device(s) 4A is/are preferably arranged parallel to the transport devices 4A shown in the figures and/or has/have transport directions parallel to the transport directions R1 and/or R2. The further transport devices 4A are preferably arranged immediately adjacent to the transport devices 4A shown in the figures, for example above, below, next to and/or between them. In particular, the transport devices 4A form a circuit for the spectacle lenses 2 and/or transport containers 5. For this purpose, the transport system 4 and/or the further transport devices 4A can in particular have one or more (additional) changing devices 4B.

As an alternative or in addition to the formation of a circuit, it can be provided to stop the transport containers 5 or spectacle lenses 2 by means of the further transport device 4A as required and/or to move or transport them forward and/or backward, in particular along and/or against the transport direction R1 and/or R2. Preferably, the same (further) transport device 4A is designed for stopping and/or for moving or transporting the transport containers 5 or spectacle lenses 2 in two mutually opposite directions. Several connections or (changing) devices can be provided for connecting the further transport device(s) 4A, so that at different positions transport containers 5 or spectacle lenses 2 can change between the further transport device 4A and a transport device 4A which transports the spectacle lenses 2 along the processing stations 3, and/or overtaking of spectacle lenses 2 or transport containers 5 is made possible.

An overtaking of spectacle lenses 2 or transport containers 5 can alternatively or additionally also be enabled or realized via a parking or waiting area for the transport containers 5. The waiting area can have or be formed by a (stationary) transport device 4A, in particular a stationary conveyor belt, or another device which is suitable for temporarily receiving or temporarily holding a transport container 5, such as a shelf or the like. Preferably, the parking or waiting area is arranged between the transport devices 4A. The parking or waiting area is preferably connected to the transport devices 4A via a changing device 4B, so that the transport containers 5 can be changed or transferred between the storage or waiting area and the transport devices 4A by means of the changing device 4B.

In particular, the further transport device(s) 4A and/or the waiting area make it possible that transport containers 5 or spectacle lenses 2 are conveyed past one or more processing stations 3, i.e. to omit individual processing stations 3, and/or spectacle lenses 2 are not processed in all processing stations 3 or only in selected processing stations 3.

Preferably, the transport system 4 is only provided or designed for transporting the transport containers 5. The handling of the spectacle lenses 2 itself, in particular the handing over of the spectacle lenses 2 to the processing stations 3 and the removal of the spectacle lenses 2 from the processing stations 3, is preferably performed by means of the handling apparatuses 6, 7, 18.

The handling apparatuses 6, 7, 18 preferably operate independently of the transport system 4 and/or are controlled separately.

For processing, the spectacle lenses 2 are preferably removed from the transport system 4 or transport container 5 by means of one of the handling apparatuses 6, 7, 18 and/or placed back into the same transport container 5 after processing or handed over to the transport system 4 or transport container 5.

In particular, the transport container 5 is further transported by means of the transport system 4, while spectacle lenses 2 removed from the transport container 5 are processed in one or more processing stations 3 and/or handled by means of the handling apparatus 6, 7.

The transport system 4 preferably has one or more stoppers 4C.

The stopper 4C is preferably designed to stop or halt transport containers 5 or to (temporarily) prevent further transport of transport containers 5.

In particular, the stopper 4C is formed by a plate or a slider that can be moved perpendicularly to the transport device 4A or the conveyor belt, in particular in the Z-direction.

The stopper 4C is preferably assigned to a processing station 3 and/or positioned near or in front of the processing station 3 in such a way that the spectacle lens 2 can be removed from the transport container 5 by means of the handling apparatus 6, 7, 18 and/or handed over to the processing station 3.

In particular, a stopper 4C can (additionally) be arranged at the entrance E and/or at the exit A and/or the stopper 4C can be assigned to different transport directions. This is particularly advantageous if the transport device 4A, to which the stopper 4C is assigned, is designed to transport containers 5 or spectacle lenses 2 in opposite directions or back and forth.

The processing system 1 or transport system 4 preferably has one or more storage devices 4D for storing transport containers 5 or spectacle lenses 2.

The storage device 4D is preferably designed to temporarily hold or temporarily store one or more transport containers 5. In particular, the transport containers 5 can be stacked in the storage device 4D or arranged vertically or one above the other in the Z direction.

The storage device 4D is preferably arranged in the vicinity of the entrance E and/or exit A of the transport system 4. Preferably, the storage device 4D is arranged at an end of the transport system 4 opposite the changing device 4B.

According to a preferred embodiment, each of the transport devices 4A comprises a storage device 4D, in particular in the vicinity of the entrance E and/or exit A.

Alternatively or additionally, the transport device 4A can have several storage devices 4D, for example in the vicinity of the changing device 4B and/or between two processing stations 3 (in each case).

The external transfer system 16 is preferably formed by one or more conveyor belts.

The conveying direction of the transfer system 16 or the conveyor belt preferably runs in the Y-direction and/or transversely, in particular perpendicularly, to the transport devices 4A and/or the transport directions R1, R2.

In FIG. 1, the transfer system 16 is indicated as a continuous conveyor belt from which two sections branch off transversely and connect the transfer system 16 to the transport system 4 or its entrance E and exit A. In this embodiment, preferably a transverse conveying of the transport containers 5 to the entrance E and/or from the exit A takes place. The processing system 1 or the transport system 4 is preferably arranged transversely, in particular perpendicularly, to the transfer system 16 and/or to a main conveying direction H of the transfer system 16. In particular, the transport direction R1, R2 runs transversely, in particular perpendicularly, to the main conveying direction H of the transfer system 16.

The orientation of the transport containers 5 with respect to the transfer system 16 or the main conveying direction H may be maintained or may change during the transition between the transfer system 16 and the transport system 4.

According to one example, the transfer system 16 or processing system 1 has curve elements at each of the entrance E and exit A, via which sections of the transfer system 16 running transversely or at right angles to the main conveying direction H are connected to a conveyor belt of the transfer system 16 that conveys the transport containers 5 in the main conveying direction H. In this case, the transport containers 5 are conveyed in a curve before the entrance E and are also conveyed in a curve after the exit A, so that the transport system 4 and the transfer system 16 form a continuous conveyor belt with several bends or curves. As the case may be, in this embodiment it is not possible to transport the transport containers 5 past the processing system 1 by means of the transfer system 16. In this embodiment, the orientation of the transport containers 5 with respect to the main conveying direction H changes at the transition between the transfer system 16 and the transport system 4. However, with respect to the respective "local" conveying direction, i.e. the main direction H in the transfer system 16 and the conveying direction R1, R2 in the transport system 4, the orientation of the transport containers 5 is maintained. This can also be achieved by rotating the transport containers 5 before they enter the processing system 1 or after they leave the processing system 1, without providing cam elements.

However, solutions are also possible in which the transport containers 5 are not rotated or the orientation of the transport containers 5 relative to the transfer system 16 or the main conveying direction H is maintained during the transition between the transfer system 16 and the processing system 1 or transport system 4.

The processing system 1 or transport system 4 and/or the handling apparatuses 6, 7, 18 preferably have a sensor 4F with which it can be determined whether there are one or more spectacle lenses 2 in a transport container 5.

Particularly preferably, the sensor 4F is designed as a sensing device. In particular, the sensor 4F is arranged laterally on the transport device 4A in such a way that a feeler of the sensor 4F can be moved vertically or in the Z direction and/or is arranged above the transport containers 5 or spectacle lenses 2 transported with the transport device 4. Preferably, by moving the feeler, in particular in the Z direction, it can be determined whether there are one or two spectacle lenses 2 in a transport container 5.

Preferably, the sensor 4F has several, in particular two, feelers arranged next to each other.

The processing system 1 or transport system 4 and/or the handling apparatuses 6, 7, 18 can have several sensors 4F. For example, several or all processing stations 3 can each be assigned a sensor 4F.

In an embodiment not shown, the transport system 4 or the transport device 4A can be of interchangeable and/or modular design or form a module or an interchangeable unit. The transport system 4 or the transport device 4A is preferably designed in such a way that it can be moved and/or exchanged out of the processing system 1 at least substantially completely or as a unit. In particular, this is advantageous in order to enable or facilitate repair, maintenance, inspection, servicing and/or access to the transport device 4A and/or the transport system 4.

Handling Apparatus Processing Side

While the handling apparatuses 6-8, 18 are only indicated very schematically in FIG. 1 for the sake of clarity and have been omitted in FIG. 2, FIGS. 4 and 5 show the processing system 1 with the handling apparatus 6 in different views. FIGS. 6 and 7 show the handling apparatus 6 in different views.

The handling apparatus 6 is preferably designed for handling spectacle lenses 2, in particular for handling several spectacle lenses 2 simultaneously, especially preferably two spectacle lenses 2.

Preferably, the handling apparatus 6 is assigned to several processing stations 3, in particular the milling station 3A and the turning station 3B, and/or is arranged on the processing side 1A.

The handling apparatus 6 is preferably designed for handing over spectacle lenses 2 between the transport system 4 and several processing stations 3. In particular, the handling apparatus 6 is designed for the direct handing over of spectacle lenses 2 to a workpiece spindle or a chuck 2D of the workpiece spindle of the milling station 3A and/or the turning station 3B.

The handling apparatus 6 is preferably movable along or parallel to the transport system 4, and/or parallel to the X-axis.

The handling apparatus 6 is preferably arranged at least partially above the transport system 4 and/or designed for handling the spectacle lenses 2 from above the transport system 4 and/or the transport devices 4A. This is conducive to a compact design.

The handling apparatus 6 or at least parts thereof are preferably arranged vertically above the transport system 4 or the transport device 4A. In particular, this is conducive to a compact design of the processing system 1.

The handling apparatus 6 preferably has several movement axes B1, B2, B3 and/or is movable or displaceable along the movement axes B1-B3. Preferably, the movement axis B1, the movement axis B2 and/or the movement axis B3 is a linear movement axis.

The movement axis B1 preferably runs at least essentially horizontally and/or parallel to the X axis.

Particularly preferably, the movement axis B1 runs parallel to the transport device 4A or transport direction R1, R2.

The movement axis B1 is preferably arranged vertically above or above the transport system 4.

The movement axis B2 preferably runs transversely, in particular orthogonally, to the movement axis B1. Preferably, the movement axis B2 runs at an angle to the vertical or Z-direction and/or at least partially above the transport system 4.

The movement axis B3 preferably runs vertically and/or perpendicularly and/or in the Z direction.

The handling apparatus 6 preferably has a rail or guide 6A or is arranged thereon. The handling apparatus 6 is preferably movable along the guide 6A or parallel to the guide 6A.

In particular, the guide 6A is designed as a linear guide and/or arranged parallel to the transport device 4A or transport direction R1, R2 and/or X axis.

The guide 6A is preferably arranged above, in particular vertically or centrally above, the transport device 4A or the transport system 4.

Preferably, the guide 6A has or forms the movement axis B1.

For better differentiation, the guide 6A is also referred to as longitudinal guide 6A in the following.

The handling apparatus 6 preferably has a guide 6B, hereinafter also referred to as transverse guide 6B for better differentiation.

The longitudinal guide 6A and/or transverse guide 6B are preferably formed by or have a guide rail and/or a carriage. The transverse guide 6B is preferably slidably mounted on the longitudinal guide 6A and/or movable or displaceable along the longitudinal guide 6A.

The transverse guide 6B is preferably arranged transversely, in particular orthogonally, to the longitudinal guide 6A and/or movement axis B1.

Preferably, the transverse guide 6B is arranged at least partially above the transport system 4.

The transverse guide 6B preferably runs at an angle to the vertical or Z axis and/or perpendicularly to the X axis.

Preferably, the transverse guide 6B has or forms the movement axis B2.

The handling apparatus 6 preferably has an adjusting device 6C.

The adjusting device 6C is preferably movable or adjustable in the Z direction or along the movement axis B3. Preferably, the adjusting device 6C forms or has the movement axis B3.

The adjusting device 6C is preferably slidably mounted on the transverse guide 6B and/or movable or displaceable along the transverse guide 6B and/or movement axis B2.

The handling apparatus 6 preferably has a swivel head 6D. Preferably, the adjusting device 6C has the swivel head 6D or the swivel head 6D is arranged on the adjusting device 6C, in particular at its lower end.

The swivel head 6D can preferably be swiveled about a swivel axis, as indicated by an arrow in FIG. 7. Preferably, the swivel axis runs perpendicular to the movement axis B3 or Z direction and/or in Y direction.

The swivel head 6D can preferably be swiveled by at least about 90°.

The handling apparatus 6, in particular the swivel head 6D, preferably has several holding devices 6E, in particular grippers and/or suction cups, for holding spectacle lenses 2. In the illustrated example, the holding devices 6E are each designed as suction cups. The suction cups or holding devices 6E are preferably arranged at an angle of about 90° to one another. In particular, this supports fast changing of spectacle lenses 2.

The handling apparatus 6 or the swivel head 6D is preferably designed to hold two spectacle lenses 2 simultaneously.

Preferably, the following procedure is used to exchange spectacle lenses 2 or to exchange a processed spectacle lens 2 for a spectacle lens 2 to be processed in a processing station 3, in particular the milling station 3A and/or the turning station 3B.

Preferably, during the processing of a first spectacle lens 2 in a processing station 3, in particular in the milling station 3A and/or turning station 3B, the swivel head 6D or one of the holding devices 6E is positioned above a transport container 5 with a second spectacle lens 2 to be processed and this second spectacle lens 2 is gripped by means of the holding device 6E and removed from the transport container 5. Then, preferably, the swivel head 6D with the second spectacle lens 2 to be processed is moved into the vicinity of the processing station 3, in particular in such a way that the first spectacle lens 2 can be removed from the processing station 3 as quickly as possible with the swivel head 6D or the free holding device 6E when the processing is finished.

When the first spectacle lens 2 is now finished being processed in the processing station 3, the handling apparatus 6 or the swivel head 6D is preferably moved or displaced to the finished processed spectacle lens 2 and the finished processed first spectacle lens 2 is gripped with the unoccupied holding device 6E and removed from the chuck 2D. Subsequently, the swivel head 6D is preferably swiveled, preferably by about 90°, and, if necessary, the adjusting device 6C is moved before, during and/or after the swiveling of the swivel head 6D, so that the second spectacle lens 2 to be processed can be inserted into the processing station 3, in particular a chuck 2D of a workpiece spindle of the processing station 3. The second spectacle lens 2 is inserted into the processing station 3 or the chuck 2D. Afterwards, the swivel head 6D with the finished processed spectacle lens 2 is preferably moved out of the processing station 3 again.

Preferably, the finished processed spectacle lens 2 is then optionally handed over to a further processing station 3, in particular the turning station 3B, or to the transport container 5 for the spectacle lens 2.

The handling of spectacle lenses 2 with the handling apparatus 6 preferably takes place during the processing of further spectacle lenses 2 in the processing stations 3, in particular the milling station 3A and/or the turning station 3B. In particular, during the processing of one or more spectacle lenses 2 in the milling station 3A and/or turning station 3B, one or more further spectacle lenses 2 are removed from transport containers 5, deposited in transport containers 5 and/or transferred between the transport containers 5 and/or the processing stations 3.

In this way, the processing times of the processing stations 3 can be used sensibly and the throughput of spectacle lenses 2 can be increased or downtimes of the processing stations 3 can be minimized. The processing times for a spectacle lens 2 are typically about 10 to 15 seconds in the milling station 3A and typically about 30 seconds in the turning station 3B. Therefore, for optimum utilization of the processing system 1, it is particularly advantageous, especially in the case of the turning station 3B, to change the spectacle lenses 2 quickly and/or to use the time in which one or more spectacle lenses 2 are being processed in the turning station 3B for further handling steps.

Handling Apparatus Polishing Side

FIGS. 8 and 9 show the processing system 1 with the handling apparatus 7 in different views. FIGS. 10 and 11 show the handling apparatus 7 in different views.

The handling apparatus 7 is preferably designed for handling spectacle lenses 2, in particular for handling several spectacle lenses 2 simultaneously, particularly preferably four spectacle lenses 2 or two pairs of spectacle lenses 2.

Preferably, the handling apparatus 7 is assigned to several processing stations 3, in particular one or more polishing stations 3D and/or the cleaning station 3E, and/or is arranged on the polishing side 1B.

The handling apparatus 7 is preferably designed for handing over spectacle lenses 2 between the transport system 4 and several processing stations 3, in particular the polishing station 3D and/or cleaning station 3E. In particular, the handling apparatus 7 is designed for the direct handing over of spectacle lenses 2 to one or more workpiece spindles or chucks 2D of the workpiece spindles of the polishing station 3D.

The handling apparatus 7 is preferably movable along and/or parallel to the transport system 4 or at least one of the transport devices 4A, in particular parallel to the X axis. Alternatively or additionally, the handling apparatus 7 of the polishing side 1B and the handling apparatus 6 of the processing side 1A are arranged and/or movable parallel to each other.

The handling apparatus 7 is preferably arranged at least partially above the transport system 4 and/or designed for handling the spectacle lenses 2 from above the transport system 4 or the transport devices 4A. This is conducive to a compact design.

The handling apparatus 7 or at least parts thereof are preferably arranged vertically above the transport system 4 or the transport device 4A. In particular, this is conducive to a compact design of the processing system 1.

The handling apparatus 7 preferably has several movement axes B4, B5, B6 and/or is movable or displaceable along the movement axes B4-B6.

The movement axis B4 preferably runs at least substantially horizontally and/or parallel to the X axis. The movement axis B4 is preferably arranged perpendicularly above the transport system 4 or the transport device 4A. The movement axis B4 is preferably a linear movement axis.

The movement axis B5 preferably runs vertically or perpendicularly or in the Z direction. The movement axis B5 is preferably a linear movement axis.

The handling apparatus 7 preferably has two, in particular parallel, movement axes B5.

The movement axis B6 preferably runs vertically or perpendicularly or in the Z direction. The movement axis B6 is preferably a swivel or rotation axis.

Preferably, the handling apparatus 7 has two, in particular parallel, movement axes B6 or swivel axes or rotation axes.

The handling apparatus 7 preferably has a guide 7A or is arranged thereon. The handling apparatus 7 is preferably displaceable along or parallel to the guide 7A.

In particular, the guide 7A is designed as a linear guide and/or is arranged parallel to the transport device 4A or transport direction R1, R2 and/or to the guide 6A of the handling apparatus 6 of the processing side 1A.

The guide 7A is preferably arranged above, in particular (perpendicularly) above, the (polishing-side) transport device 4A or the transport system 4.

Preferably, the guide 7A has or forms the movement axis B4.

For better differentiation, the guide 7A is also referred to as longitudinal guide 7A in the following.

The handling apparatus 7 preferably has a rail or guide 7B, hereinafter also referred to as vertical guide 7B for better differentiation.

The vertical guide 7B preferably runs vertically or in the Z direction.

Preferably, the vertical guide 7B has the movement axis B5 or the vertical guide 7B forms the movement axis B5.

The longitudinal guide 7A and/or vertical guide 7B are preferably each formed by or have a guide rail and/or a carriage.

Preferably, the handling apparatus 7 has two vertical guides 7B, in particular of similar or identical design. The vertical guides 7B are preferably arranged parallel to each other and/or next to each other.

The handling apparatus 7 preferably has an arm 7C. The arm 7C is preferably movably mounted on the vertical guide 7B and/or movable or displaceable along the vertical guide 7B. Preferably, the arm 7C projects from the vertical guide 7B at an angle to the movement axis B5.

Preferably, the handling apparatus 7 has two (at least predominantly) similar or identically formed arms 7C. In particular, the arms 7C are arranged parallel to each other and/or next to each other. Preferably, each of the arms 7C is mounted on a vertical guide 7B.

The handling apparatus 7 preferably has a carriage or carrier 7E for the arms 7C and/or vertical guides 7B. In particular, the arms 7C and/or vertical guides 7B are arranged or supported on or held by the common carrier 7E.

The arms 7C are preferably movable or displaceable independently of each other.

The arm 7C preferably has, in particular at the end or at the lower end, one or preferably more holding devices 7D for holding and/or gripping spectacle lenses 2.

Preferably, the different holding devices 7D of an arm 7C are predominantly identical in design, although preferably the holding devices 7D of the first arm 7C are designed differently from the holding devices 7D of the second arm 7C.

Preferably, the holding devices 7D of the first arm 7C are designed as suction cups and/or the holding devices 7D of the second arm 7C are designed as grippers with which the spectacle lenses 2 are held at the edge, in particular so that damage to the surfaces of the spectacle lenses is avoided. In particular, the grippers of the second arm 7C have several fingers which are applied or can be applied to the edge of the spectacle lens 2 for holding it.

In the following, for better differentiation, preferably the arm 7C with the holding devices 7D designed as suction cups is referred to as the first arm and the arm 7C with the holding devices 7D designed as grippers is referred to as the second arm.

In particular, it is provided that in the polishing station 3D spectacle lenses 2 still to be processed or polished are gripped or held with the suction cups and/or finished polished spectacle lenses 2 are gripped or held with the grippers.

Preferably, the guide 7B has the rotation axis or swivel axis or movement axis B6, or the two guides 7B each have a rotation axis or swivel axis or movement axis B6.

In particular, the arm 7C is rotatable or swivable about the vertical guide 7B or movement axis B6. By rotating or swiveling the arm 7C about the movement axis B6, the holding device 7D or the spectacle lens 2 held by it can be moved from a position above the transport system 4 or transport container 5 into a position above the polishing station 3D, in particular a workpiece spindle of the polishing station 3D.

Preferably, the two arms 7C are rotatable in opposite directions about their respective axis of rotation B6, in particular simultaneously.

The handling of spectacle lenses 2 by means of the handling apparatus 7 is preferably performed as follows:

The first arm 7C is preferably moved over a transport container 5 with one or two spectacle lenses 2. The spectacle lenses 2 located in the transport container 5 are gripped or sucked in by means of the holding devices 7D, wherein for this purpose the arm 7C is moved or can be moved vertically or along the movement axis B5 and/or vertical guide 7B.

The first arm 7C is then moved upward along the movement axis B5 and rotated about the movement axis B6, preferably by about 180°.

If necessary, for positioning the holding device 7D or spectacle lenses 2 or for changing the spectacle lenses 2 in the polishing station 3D, the handling apparatus 7 is also moved along the longitudinal guide 7A or along the movement axis B4.

In particular, the handling apparatus 7 and/or the second arm 7C are moved in such a way that the grippers of the second arm 7C are in a position in which they can remove finished polished spectacle lenses 2 from the polishing station 3D or workpiece spindle of the polishing station 3D.

When the spectacle lenses 2 have been finished polishing in the polishing station 3D, preferably first the second arm 7C is moved along the movement axis B5, the finished polished spectacle lenses 2 located in the polishing station 3D are gripped and removed from the polishing station 3D by moving the arm 7C back along the movement axis B5 or the vertical guide 7B. Then, preferably, the handling apparatus 7 is moved along the movement axis B4 or longitudinal guide 7A so that the first arm 7C with the stocked spectacle lenses 2 or those to be polished is positioned above the polishing station 3 or its workpiece spindles. Then, preferably, the first arm 7C is moved or lowered along the movement axis B5 or vertical guide 7B and the spectacle lenses 2 are inserted into the polishing station 3D.

The handling apparatus 7 is then preferably moved in such a way that the finished polished spectacle lenses 2 held by the grippers can be cleaned in the cleaning station 3E. After cleaning, the finished polished and cleaned spectacle lenses 2 are preferably placed back into the transport container 5, for which purpose the handling apparatus 7 is moved accordingly.

The polishing of a spectacle lens 2 or the simultaneous polishing of two spectacle lenses 2 in the polishing station 3D usually takes about 2 to 3 minutes. Therefore, similar to the handling apparatus 6 of the processing side 1A, it is advantageous for an optimal utilization of the processing system 1 or the polishing station 3D to change the spectacle lenses 2 as quickly as possible and to carry out the further handling of the spectacle lenses 2, such as removal from transport containers 5, transfer from the polishing station 3D to the cleaning station 3E or the like, during the processing of further spectacle lenses 2 in the polishing station 3D. In this way, the processing times of the processing stations 3 or polishing stations 3D can be used sensibly, in particular for further handling steps of spectacle lenses 2, and the throughput of spectacle lenses 2 can be increased or downtimes of the processing station(s) 3 or polishing station(s) 3D can be minimized.

The handling of spectacle lenses 2 with the handling apparatus 7 preferably takes place during the processing of further spectacle lenses 2 in the processing stations 3, in particular the polishing stations 3D. In particular, during the processing of one or more spectacle lenses 2 in the polishing stations 3D, one or more further spectacle lenses 2 are removed from a transport container 5, deposited in a transport container 5, cleaned in the cleaning station 3E and/or transferred between transport containers 5, the processing stations 3 and/or the cleaning station 3E.

Handling Apparatus for Tools

FIGS. 12 and 13 show the processing system 1 with the handling apparatus 8 for tools 15, in particular polishing tools. FIG. 14 shows the tool magazine 14 and the cleaning station 3E. FIG. 15 shows the tool magazine 14 and the handling apparatus 8 for tools 15. FIG. 16 shows a perspective view of the handling apparatus 8 for tools 15. In the following, properties and features of the handling apparatus 8 are explained in particular with reference to FIGS. 12-16.

The handling apparatus 8 is preferably assigned to the polishing station(s) 3D and/or the tool magazine 14. In particular, the handling apparatus 8 is arranged on the polishing side 1B and/or between the polishing stations 3D. The handling apparatus 8 is preferably movable between the polishing stations 3D and the tool magazine 14.

The handling apparatus 8 is preferably arranged laterally offset in the Y direction with respect to the transport system 4 or the transport device 4A and/or on the side of the handling apparatus 7 for spectacle lenses 2 facing away from the transport device 4.

The handling apparatus 8 for the tools 15 is preferably movable independently of the handling apparatus 7 for spectacle lenses 2, in particular in the X direction.

The handling apparatus 8 preferably has several movement axes B7, B8. Preferably, the movement axis B7 and/or the movement axis B8 is a linear movement axis.

Preferably, the movement axis B7 runs at least essentially horizontally and/or in the X direction. Preferably, the movement axis B7 runs parallel to the transport direction R1, R2, to the transport device 4A and/or to the movement axis B4 of the handling apparatus 7.

The movement axis B8 preferably runs vertically or perpendicularly or in the Z direction and/or parallel to the movement axis B5 of the handling apparatus 7. The movement axis B8 is preferably a linear movement axis.

The handling apparatus 8 preferably has two movement axes B8.

The handling apparatus 8 preferably has a guide 8A or is arranged thereon. The guide 8A is preferably arranged above the transport system 4, the polishing station 3D, the tool magazine 14 and/or the cleaning station 3E.

In particular, the guide 8A is designed as a linear guide and/or is arranged parallel to the transport device 4A or transport direction R1, R2 and/or to the guide 7A of the handling apparatus 7.

The handling apparatus 8 is preferably displaceable along the guide 8A or parallel to the guide 8A. Preferably, the guide 8A has or forms the movement axis B7.

For better differentiation, the guide 8A is also referred to as longitudinal guide 8A in the following.

The handling apparatus 8 preferably has a (further) guide 8B, hereinafter also referred to as vertical guide 8B for better differentiation.

The vertical guide 8B preferably runs vertically or in the Z direction. Preferably, the vertical guide 8B has or forms the movement axis B8.

Preferably, the handling apparatus 8 has two vertical guides 8B, in particular of similar or identical design.

The longitudinal guide 8A and/or vertical guide 8B are preferably each formed by or have a guide rail and/or a carriage.

The vertical guide 8B is preferably movably mounted on the longitudinal guide 8A and/or movable or displaceable along the longitudinal guide 8A.

The handling apparatus 8 preferably has an arm 8C. The arm 8C is preferably arranged on the vertical guide 8B and/or can be moved longitudinally to the vertical guide 8B. The arm 8C preferably extends in the Z-direction or parallel to the vertical guide 8B or movement axis B8.

Preferably, the handling apparatus 8 has two arms 8C, in particular of similar or identical design. The arms 8C are in particular arranged parallel to each other and/or next to each other. Preferably, each of the arms 8C is mounted on a vertical guide 8B.

The handling apparatus 8 preferably has a carriage or carrier 8E for the arms 8C and/or vertical guides 8B. In particular, the arms 8C and/or vertical guides 8B are arranged or supported on or held by the common carrier 8E.

The arms 8C are preferably movable or displaceable independently of each other.

The arm 8C preferably has, in particular at the end or at the lower end, one or preferably more grippers or holding devices 8D for holding or gripping tools 15, in particular polishing tools. Particularly preferably, the handling apparatus 8 has four holding devices 8D and/or each arm 8C has two holding devices 8D. The holding devices 8D are preferably arranged on a cross strut of the arm 8C and/or next to each other.

Preferably, the tools 15 have a gripping groove extending in particular in the circumferential direction, in which the holding devices 8D can engage or.

The holding devices 8D are preferably arranged at a fixed distance from each other. In particular, the distance between the holding devices 8D corresponds to the distance between the tools 15 arranged on the tool magazine 14.

Preferably, the holding devices 8D can be moved or displaced transversely, in particular perpendicularly, to the arm 8C or the direction of movement B8, preferably in the Y direction. This facilitates or enables the removal of tools 15 from the tool magazine 14.

In particular, the handling apparatus 8 is designed for changing tools 15 in pairs. The arm 8C or the holding devices 8D is/are preferably designed for holding or gripping two polishing tools simultaneously or in pairs.

Preferably, the handling of tools 15 by means of the handling apparatus 8 is performed as follows:

The handling apparatus 8 is preferably positioned with one of the arms 8C by moving along the movement axis B7 and/or the movement axis B8 relative to the tool magazine 14 in such a way that one or two tools 15 or polishing tools can be gripped and/or removed from the tool magazine 14 by means of the holding devices 8D of the arm 8C.

Preferably, two tools 15 are gripped and/or removed from the tool magazine 14, in particular simultaneously, with the holding devices 8D of the arm 8C.

Preferably, the holding devices 8D engage in a groove of the tools 15 provided for this purpose in order to remove the tools 15. The holding devices 8D with the gripped tools 15 are then preferably moved a short distance away from the tool magazine 14 in order to release the tools 15 from the tool magazine or respective holders.

Then, the handling apparatus 8 is preferably moved to the polishing station 3D. When a polishing of spectacle lenses 2 in the polishing station 3D is finished, one or two tools 15 are preferably removed from the polishing station 3D with the unoccupied arm 8C by moving this arm 8C accordingly and gripping the tools 15.

Preferably, the arm 8C now preferably moves out of the polishing station 3D again. Then, preferably, the handling apparatus 8 is moved, preferably in the X direction or along the movement axis B7, so that the tools 15 already stocked with the other arm 8C can be inserted into the polishing station 3D.

Then, preferably, the tools 15 held or stocked with the other arm 8C are inserted into the polishing station 3D, for which the arm 8C is moved accordingly. The arm 8C or the holding devices 8D are then moved out of the polishing station 3D again.

Preferably, the handling apparatus 8 is then moved back to the tool magazine 14 and/or the used tools 15 are deposited in the tool magazine 14.

Preferably, in the polishing station 3D, the changing of the tools 15 by means of the handling apparatus 8 is carried out simultaneously with the changing of the spectacle lenses 2 by means of the handling apparatus 7. The handling apparatuses 7 and 8 are preferably arranged or designed in such a way that the arms 7C, 8C or holding devices 7D, 8D can be moved or displaced into a working space of the polishing station 3D simultaneously or at least directly one after the other.

In particular, the handling apparatus 7 for the spectacle lenses 2 and the handling apparatus 8 for the tools 15 operate independently of each other and/or the handling apparatuses 7, 8 do not have common movement axes.

The tools 15 can be cleaned in the cleaning station 3E before being deposited in the tool magazine 14.

Tool Magazine and Cleaning Station

The tool magazine 14 is preferably assigned to the polishing station 3D or polishing stations 3D and/or arranged between two polishing stations 3D. Preferably, a large number of tools 15, in particular polishing tools, are stored or can be stored in the tool magazine 14.

The tool magazine 14 preferably has or is formed by an (at least substantially cylindrical) drum 14B on which the tools 15 are arranged or held in the circumferential direction. The tools 15 held by the tool magazine are preferably radially aligned on the tool magazine 14.

A longitudinal axis L of the tool magazine 14 or the drum 14B preferably runs horizontally and/or parallel to the transport system 4 and/or the conveying direction R1, R2 and/or to the movement axis B7 and/or in the X direction.

The drum 14B is preferably rotatable about the longitudinal axis L, in particular so that the tools 15 can each be moved into a position in which they can be gripped with the holding devices 8D of the handling apparatus 8 for the tools 15, in particular from above or a position above the tool magazine 14. Preferably, horizontally aligned tools 15 are gripped with the handling apparatus 8 or its holding devices 8D.

Preferably, the tool magazine 14 or the drum 14B is exchangeable or removable from the processing system 1. This enables a quick exchange of a large number of tools 15. This minimizes downtimes.

The drum 14B and/or the tool magazine 14 is preferably arranged on a rotary axis or shaft 14A and/or is rotatably mounted by means of the shaft 14A.

Preferably, the drum 14B or the tool magazine 14 has an in particular radial and/or slot-like recess 14C, preferably so that the drum 14B and/or the tool magazine 14 can be pushed onto the shaft 14A or arranged on the shaft 14A by a linear movement in radial direction to the longitudinal axis L of the drum 14B. Preferably, the recess 14C extends over approximately half the diameter of the drum 14B and/or from the edge to approximately the center or longitudinal axis L of the drum 14B. Further, the recess 14C preferably extends along the entire length of the drum 14B parallel to the longitudinal axis L. This allows the tool magazine 14 to be easily changed.

In the illustrative example, the tool magazine 14 and/or the drum 14B has several, here four, separate segments 14D or is formed by them. The segments 14D are preferably ring-like and/or circular disc-like.

Preferably, the segments 14D are rigidly or non-rotatably connected to each other, for example by means of a connecting element such as a rod or the like, and/or form a structural unit. In this way, in particular the drum 14B can be replaced or exchanged as a whole, or the segments 14D can be replaced or exchanged together, which is advantageous in particular for a quick and uncomplicated exchange. However, it is also possible that the segments 14D are not connected to each other and, in particular, can be exchanged or replaced individually.

The cleaning station 3E is preferably designed for cleaning or washing and/or drying spectacle lenses 2 and/or tools 15.

The cleaning station 3E preferably has several nozzles 17 for dispensing or spraying a preferably liquid cleaning agent, in particular water. By means of the cleaning station 3E and/or the nozzles 17, residues of a polishing agent can preferably be removed, in particular rinsed off, from the tools 15 and/or spectacle lenses 2.

The cleaning station 3E preferably comprises a washing container 19, in particular wherein the nozzles 17 are arranged in the washing container 19.

Preferably, the washing container 19 is designed to collect and/or drain the cleaning liquid sprayed by the nozzles 17 and/or the contaminants rinsed off the tools 15 or spectacle lenses 2.

Preferably, the tool magazine 14 is integrated in the cleaning station 3E and/or in the washing container 19 and/or the washing container 19 or the cleaning station 13E and the tool magazine 14 form a structural unit.

The cleaning station 3E is preferably designed alternatively or additionally for drying the (cleaned or rinsed) spectacle lenses 2 and/or tools 15. Drying can remove residues or residues of the cleaning agent, in particular water.

For drying, the cleaning station 3E preferably has a blower for blowing away residues of the cleaning agent, in particular liquid residues or drops, or other deposits or soiling.

Alternatively or additionally, the cleaning station 3E can also have a device for heating the tools 15 and/or spectacle lenses 2 so that drying can take place by evaporation of the cleaning agent or liquid.

The processing system 1 can alternatively or additionally also have one or more cleaning stations 3E, for example for cleaning the spectacle lenses 2 after milling and/or turning. For this purpose, corresponding cleaning stations 3E are preferably arranged immediately downstream of the milling stations 3A and/or turning station 3B and/or in the vicinity of these stations. As the case may be, some of the cleaning stations 3E are also designed only for drying spectacle lenses 2 or blowing away deposits or contamination.

The cleaning of tools 15 and/or spectacle lenses 2 is preferably performed during a processing of further spectacle lenses 2 in the polishing station 3D or polishing stations 3D or simultaneously therewith.

Signing Station

The marking or signing station 3C is designed for marking or signing spectacle lenses 2, in particular with a laser 21 or laser beam.

By means of the signing station 3C, preferably markings or signatures for a later processing, which for example indicate or identify a position of optical axes, other indications or the like, can be introduced into a spectacle lens 2. This is particularly important for a later edge processing or edging of the spectacle lens 2, in which the spectacle lens 2 is adapted to the shape of an associated spectacle frame, so that the spectacle lens 2 or its optical axes lie in the correct relative orientation to the spectacle frame.

The signing station 3C preferably has an integrated handling apparatus 18 for handling spectacle lenses 2.

The handling apparatus 18 is preferably designed to remove a spectacle lens 2 from a transport container 5 or from the transport system 4 and/or to move it into a signing position in which marking or signing is performed.

The handling apparatus 18 is preferably movable transversely, in particular perpendicularly, to the transport system 4, the transport direction R1, R2 and/or the X-axis and/or parallel to the Y-axis.

The handling apparatus 18 is preferably arranged at least partially above the transport system 4 and/or designed to handle the spectacle lenses 2 from above the transport system 4 or the transport device 4A. This is conducive to a compact design. The handling apparatus 18 or at least parts thereof are preferably arranged vertically above the transport system 4 and/or the corresponding transport device 4A. In particular, this is conducive to a compact design of the processing system 1.

The handling apparatus 18 preferably has a plurality of movement axes B9, B10 and/or is movable or traversable along the movement axes B9, B10. Preferably, the movement axis B9 and/or the movement axis B10 is a linear movement axis.

Preferably, the movement axis B9 runs at least substantially horizontally and/or parallel to the Y-axis. Particularly preferably, the movement axis B9 runs transversely, in particular perpendicularly, to the transport device 4A or transport direction R1, R2 and/or to the X axis, The movement axis B10 preferably runs transversely, in particular orthogonally, to the movement axis B9. Preferably, the movement axis B10 runs vertically or perpendicularly or in the Z direction. The movement axis B10 is preferably arranged over or above the transport system 4.

The handling apparatus 18 preferably has a guide 18A or is arranged thereon. The handling apparatus 18 is preferably displaceable along or parallel to the guide 18A.

In particular, the guide 18A is designed as a linear guide and/or is arranged transversely, in particular perpendicularly, to the transport device 4A or transport direction R1, R2 and/or X axis and/or parallel to the Y axis.

The guide 18A is preferably arranged at least partially vertically above the transport device 4A or the transport system 4.

Preferably, the guide 18A has or forms the movement axis B9.

For better differentiation, the guide 18A is also referred to as transverse guide 18A in the following.

The handling apparatus 18 preferably has a guide 18B, hereinafter also referred to as vertical guide 18B for better distinction.

The transverse guide 18A and/or vertical guide 18B are preferably formed by or have a guide rail and/or a carriage. The vertical guide 18B is preferably movably mounted on the transverse guide 18A and/or movable or displaceable along the vertical guide 18A.

The vertical guide 18B is preferably arranged transversely, in particular orthogonally, to the transverse guide 18A and/or movement axis B9.

Preferably, the vertical guide 18B has or forms the movement axis B10.

The handling apparatus 18 preferably has a holding device 18C. The holding device 18C is preferably displaceable in the Z direction and/or along the movement axis B10.

The holding device 18C is preferably displaceably mounted on the vertical guide 18B and/or movable or displaceable along the vertical guide 18B or movement axis B10.

The holding device 18C preferably has or is formed by a suction cup for holding or gripping a spectacle lens 2.

The signing station 3C preferably has a laser 21 for marking or signing the spectacle lenses 2.

The laser 21 may be designed to generate different laser beams, in particular to generate laser beams for signing the spectacle lenses 2 and to generate laser beams for measuring the spectacle lenses 2. These laser beams may differ, for example, in wavelength, intensity and/or power.

The laser 21 is preferably arranged transversely, in particular perpendicularly, to the transport system 4 or the transport direction R1, R2 and/or to the X axis.

Preferably, the laser 21 is arranged horizontally and/or above the transport system 4 or at least partially or in sections above the transport system 4.

Preferably, the laser 21 is arranged parallel to the transverse guide 18 and/or the movement axis B9. In particular, the laser 21 is arranged directly adjacent to the transverse guide 18.

Preferably, the laser beam generated by the laser 21 for marking or signing the spectacle lenses 2 is deflected, in particular by at least substantially 90° and/or from a horizontal direction to a vertical direction.

Preferably, the following procedure is used to mark or sign a spectacle lens 2 with the signing station 3C.

The spectacle lens 2 or the transport container 5 with the spectacle lens 2 is preferably first positioned in such a way that the spectacle lens 2 can be gripped by the holding device 18C. In particular, the spectacle lens 2 is positioned vertically or perpendicularly below the holding device 18C.

Preferably, the holding device 18C is then moved along the movement axes B9 and/or B10 so that the holding device 18C is preferably positioned directly above the spectacle lens 2 and can preferably grip, in particular suck, the spectacle lens 2. The spectacle lens 2 is preferably gripped by the holding device 18C.

Subsequently, the spectacle lens 2 is preferably moved into a marking position or signing position by corresponding movement along the movement axes B9 and/or B10 and deposited or positioned in the signing position or the chuck 2D. The holding device 18C is preferably moved away from the spectacle lens 2 after the depositing or positioning of the spectacle lens 2, in particular in order to enable or not to hinder a signing of the spectacle lens 2.

Particularly preferably, the spectacle lens 2 is correctly aligned in the signing position, for example rotated and/or tilted, and/or a laser beam is adjusted, moved and/or focused to the position or alignment of the spectacle lens 2 in the signing position.

It is also possible to measure or determine the orientation of the spectacle lens 2 in the signing position, in particular by means of the laser 21. This is particularly advantageous when working with blockless or non-blocked spectacle lenses 2.

Then, preferably, the spectacle lens 2 is signed or marked with the laser 21 or laser beam. Signing usually takes only a few seconds, preferably less than 5 seconds. However, signing can also take more time, for example if special characters or a logo are introduced into the spectacle lens 2.

Subsequently, the holding device 18C is preferably moved back to the spectacle lens 2, the spectacle lens 2 is gripped with the holding device 18C, the holding device 18C with the spectacle lens 2 is moved back to the transport container 5 and/or the spectacle lens 2 is deposited again in the transport container 5.

Quality Control

Preferably, after a processing in one or more of the processing stations 3, a quality control of the processed spectacle lenses 2 is carried out, in particular after polishing and/or before an edge processing or edging and/or coating of the spectacle lenses 2. For this purpose, the processed surface of the spectacle lens 2 is measured and/or checked whether the shape or surface of the processed spectacle lens 2 corresponds to a desired or predetermined shape or surface.

Preferably, the quality control is performed without contact and/or by an optical measurement of the processed spectacle lens 2, in particular by phase-measuring deflectometry (PMD) and/or by reflectance measurements.

In particular, the quality control can also be carried out in or by the signing station 3C. For this purpose, the spectacle lens 2 is preferably measured or checked by means of the laser 21.

Control and Procedure

As mentioned at the outset, the control system preferably has one or more control devices 11 and/or the control system of the processing system 1 is housed in one or more switch cabinets 11A.

Preferably, the processing system has a plurality of control devices 11 which are designed for controlling, in particular separately or independently, different components of the processing system 1, for example one or more processing stations 3, one or more handling apparatuses 6-8 and/or the transport system 4 or the transport devices 4A and/or the changing device 4B.

Preferably, the switch cabinets 11A are each assigned to one of the parts 1A, 1B. In particular, one of the switch cabinets 11A is assigned to the processing side 1A and the other switch cabinet 11A or its control device 11 is assigned to the polishing side 1B or is designed to control the components of the respective part 1A, 1B, in particular the processing stations 3, the handling apparatuses 6-8 and/or the transport device 4A.

Preferably, the control system is designed to manage processing statuses of the spectacle lenses 2.

The control system preferably forms a lens management system.

The processing status of a spectacle lens 2 is particularly important in the event of malfunctions and/or a restart of the processing system 1 and/or individual processing stations 3. In such a case, it is advantageous if the processing status of a spectacle lens 2 which has not yet been processed completely or only partially or in only some processing stations 3 can be retrieved and processing can be continued immediately after the malfunction has been rectified or after a restart.

Preferably, for each spectacle lens 2 that is or is to be processed in the processing system 1, a processing status is stored or can be stored in the control system and/or can be retrieved by the control system.

Preferably, the processing status of a spectacle lens is stored or saved in the identifier, already mentioned above, of the transport container 5 in which the spectacle lens 2 is located or to which the spectacle lens 2 is assigned, or can be retrieved by means of the identifier.

In particular, the processing status is stored externally, for example on a server or in a database. However, it is also possible to store the processing status in the identifier, for example if the identifier is designed as a writable RFID chip or the like, or to store the processing status in a memory device of the processing system 1, for example in the switch cabinet 11A.

The processing status is preferably retrieved by the control system in such a way that the identifier is first read in by the detection device 4E and then the control system retrieves the processing status by means of the identifier or information contained in the identifier.

The processing status may have or contain information about which processing operations (for example milling, turning, polishing and/or signing) have to be performed and/or have already been performed on the spectacle lens 2. Furthermore, the processing status may have information about an (expected) processing time in one or more of the processing stations 3.

Preferably, the processing status of a spectacle lens 2 is changed or updated when or after the spectacle lens 2 has been finished being processed in one of the processing stations 3. In particular, the processing stations 3 are adapted to change the processing status or to transmit information that the spectacle lens 2 has been finished being processed in the respective processing station 3. The information that the spectacle lens 2 has been processed can be transmitted, for example, to a control system or system control, a computing unit, a database, a server, the control device 11 or another device, wherein the stored processing status is changed or updated after receipt of the information.

Preferably, the spectacle lenses 2 are processed in the processing system 1 in the order in which they or the corresponding transport containers 5 enter the processing system 1 or pass through the processing system 1. Preferably, the order of the transport containers 5 in the transport system 4 is maintained while passing through the processing system 1.

However, it is also possible that—in particular depending on a processing status—by means of the handling apparatus 6, 7 the spectacle lenses 2 are not transferred to the processing stations 3 in the sequence of the transport containers 5 assigned to the spectacle lenses 2 or an overtaking of spectacle lenses 2 takes place or is made possible. For example, it is possible that from a first and second transport container 5 arranged one after the other in the transport system 4, the spectacle lenses 2 of the second transport container 5 are first transferred to one or more processing stations 3 and only after the processing of the spectacle lenses 2 of the second transport container 5, the spectacle lenses 2 of the first transport container 5 are transferred to one or more processing stations 3. This can be expedient in order to achieve the highest possible utilization or the lowest possible dead times or downtimes of individual processing stations 3, for example if the processing of the spectacle lenses 2 of the second transport container 5 takes less time than the processing of the spectacle lenses 2 of the first transport container 5.

As already explained before, one or more further transport devices 4A and/or a parking and/or waiting area can also be provided for overtaking spectacle lenses 2 and/or transport containers 5.

The actual processing sequence of the spectacle lenses 2 in the processing stations 3 can depend in particular on the processing status of the spectacle lenses 2 or be changed taking into account the processing status of the spectacle lenses 2. It is also possible that the processing sequence depends on a utilization of the processing stations 3 or is changed taking into account the utilization of the processing stations 3.

An "overtaking" of the spectacle lenses 2 or a processing of the spectacle lenses 2 in a different sequence than the sequence of the transport containers 5 assigned to the spectacle lenses 2 can be particularly expedient if several processing stations 3 or processing stations 3 of the same type are provided for the same processing, in the illustration example particularly in the case of the two polishing stations 3D. Also a failure of a processing station 3 or a faulty processing of one or more spectacle lenses 2 in a processing station 3 can lead to a change of the processing sequence.

Likewise, it is conceivable that a processing of a spectacle lens 2 must be repeated in a processing station 3 or that a spectacle lens 2 must be processed again in a processing station 3.

In another example, it may happen that spectacle lenses 2 or transport containers 5 with spectacle lenses 2 are removed from the processing system 1 or transport system 4 in the meantime and are returned to it later, so that only selected processing operations have to be carried out.

Operating Apparatus

The operating apparatus 12 is preferably designed for operating or controlling the processing system 1 and/or individual components of the processing system 1, such as the processing stations 3, the transport system 4 and/or the handling apparatuses 6-8.

The processing system 1 can preferably be operated via the input device 12B of the operating apparatus 12.

The input device 12B may have or be formed by a keyboard, one or more levers, buttons, knobs, switches, and/or other control elements and/or a touchscreen or touch-sensitive display.

The display device 12A is preferably formed by an electronic screen, in particular a touch screen or a touch-sensitive display.

Preferably, the operating apparatus 12 or display device 12A is designed to display a control menu for one or more processing stations 3, in particular different control menus for different processing stations 3.

Preferably, different processing stations 3 of the processing system 1 can be controlled or operated individually or independently of each other by means of the operating apparatus 12.

According to one aspect, the operating apparatus 12 is arranged on the arm 13, in particular at the end thereof. Preferably, the arm 13 is pivotable about a pivot axis S. Preferably, the arm 13 is a pivot arm.

The arm 13 is preferably arranged outside the housing or casing 10.

In particular, the arm 13 has several sections 13A, 13B, in particular a first section 13A and a second section 13B. The sections 13A, 13B are preferably connected to each other in an articulated manner.

The first section 13A is preferably arranged above the casing 10. Preferably, the first section 13A runs at least substantially horizontally.

The second section 13B preferably extends at least substantially vertically or in the Z-direction and/or is arranged laterally or outside the casing 10.

The second section 13B is preferably arranged at right angles to the first section 13A.

The operating apparatus 12 is preferably arranged at the second section 13B or its end.

Preferably, the second section 13B is rotatable relative to the first section 13A and/or the operating apparatus 12 is pivotable or rotatable relative to the second section 13B, in particular about the Z-axis or vertical.

In particular, the position or pivot position or pivot angle of the arm 13 and/or the relative orientation of the first section 13A, the second section 13B and/or the operating apparatus 12A to one another can be used to determine in front of which processing station 3 the operating apparatus 12 is located and/or in which direction or to which processing station 3D the operating apparatus 12 is oriented. In particular, this information can be used to display a corresponding control menu for the nearest processing station 3 and/or the processing station 3 in whose direction the operating apparatus 12 is aligned.

Preferably, the arm 13 and/or the operating apparatus 12 have one or more sensors for detecting or determining the pivot position or the pivot angle.

The arm 13, in particular the second section 13B, or the operating apparatus 12 can preferably be moved or pivoted to different sides of the processing system 1. In particular, the arm 13, in particular the second section 13B, or the operating apparatus 12 can be moved or positioned in front of each of the processing stations 3 and/or in front of the switch cabinet 11A. This allows the operating apparatus to be positioned and operated as required and conveniently for operating the processing system 1 and/or the processing stations 3.

However, it is also possible that the operating apparatus 12 is freely movable and/or not arranged on an arm 13. For example, the operating apparatus 12 can be formed by a smartphone, a tablet, a laptop or the like. Also in this case, the relative position and/or orientations of the operating apparatus with respect to the processing stations 3 can preferably be determined and a corresponding control menu displayed.

The operating apparatus 12 preferably has an emergency stop switch 12C. Preferably, one or more processing stations 3 and/or the transport system 4 or the processing system 1 as a whole can be halted or stopped by means of the emergency stop switch 12C. This increases the operating safety of the processing system 1.

Preferably, user guidance can be provided by the operating apparatus 12 and/or the control menu. In particular, the operating apparatus 12 or display device 12A issues or displays instructions to an operator, for example when a tool 15 needs to be replaced, when a maintenance, inspection, repair and/or servicing measure needs to be carried out for the respective processing station 3 and/or the transport system 4, when a part or tool needs to be replaced, when a fault has occurred, when an operating medium, such as coolant, polishing agent or cleaning agent, needs to be refilled or the like.

The operating apparatus 12 may alternatively or additionally be designed to display the processing status of one or more spectacle lenses 2, to display a utilization of one or more processing stations 3, to display operating parameters of the processing system 1 or the processing stations 3, or the like.

The processing system 1 may have an additional operating apparatus 11B, as can be seen, for example, in FIGS. 4, 8 and 13.

The operating apparatus 11B is preferably permanently installed or—in contrast to the operating apparatus 12—not movable. Preferably, the operating apparatus 11B is arranged on the switch cabinet 11A, on a transverse side or front side of the processing system 1 and/or opposite the entrance E and/or exit A.

The operating apparatus 11B preferably has a display device and/or an input device. Preferably, the explanations relating to the display device 12A and/or input device 12B of the operating apparatus 12 also apply accordingly to the operating apparatus 11.

The operating apparatus 11B is preferably designed to operate or control the (entire) processing system 1.

The operating apparatus 11B can be arranged inside or outside the casing 10 (cf. FIGS. 4 and 8).

Individual aspects and features of the processing system 1 according to the proposal and the described processes and different embodiments can also be implemented independently of one another, but also in any combination.

A superordinate aspect or a fundamental idea of the present invention, which can also form the basis of an independent claim, consists in particular in specifying a processing system or a method for processing spectacle lenses, the processing system having a plurality of processing stations and a transport system for the spectacle lenses, and a plurality of spectacle lenses being processable or being processed simultaneously in different or different types of processing stations. In particular, all further features described above are in each case not mandatory, but merely represent preferred embodiments and can be combined in any desired combination in an independent claim.

LIST OF REFERENCE SIGNS

1 Processing system
1A Part/Processing side
1B Part/polishing side
2 Spectacle lens
2A Block piece
2B Block material
2C Protective layer
2D Chuck
3 Processing station
3A Milling station
3B Turning station
3C Signing station
3D Polishing station
3E Cleaning station
4 Transport system
4A Transport device
4B Changing device
4C Stopper
4D Storage device
4E Detection device
4F Sensor
5 Transport container
6 Handling apparatus for spectacle lenses (processing side)
6A Guide/longitudinal guide
6B Leadership/cross leadership
6C Adjusting device
6D Swivel head
6E Holding device
7 Handling apparatus for spectacle lenses (polishing side)
7A Guide/longitudinal guide
7B Guide/vertical guide
7C Arm
7D Holding device
7E Carrier
8 Handling apparatus for tools
8A Guide/longitudinal guide
8B Guide/vertical guide
8C Arm
8D Holding device
8E Carrier
9 Base frame
9A Subframe
10 Casing
10A Plate
11 Control device
11A Switch cabinet
11B Operating apparatus
12 Operating apparatus
12A Display device
12B Input device
12C Emergency stop switch
13 Arm (operating apparatus)
13A first section
13B second section
13 Tool magazine
14A Shaft
14B Drum
14C Recess
14D Segment
15 Tool
16 Transfer system
17 Nozzle
18 Handling apparatus (signing station)
18A Guide/transverse guide
18B Guide/vertical guide
18C Holding device
19 Washing container
20 Supply system
20A Line
21 Laser
E Entrance
A Exit
B1 Movement axis
B2 Movement axis
B3 Movement axis
B4 Movement axis B5 Movement axis
B6 Movement axis
B7 Movement axis
B8 Movement axis
B9 Movement axis
B10 Movement axis
H Main conveying direction
L Longitudinal axis
R1 Transport direction
R2 Transport direction
S Pivot axis
X Axis
Y Axis
Z Axis

The invention claimed is:

1. A processing system configured to process spectacle lenses comprising:

several processing stations, the several processing stations configured to perform different processing operations, a transport system configured to transport the spectacle lenses and/or transport containers for the spectacle lenses within the processing system, and a common casing surrounding the processing stations and the transport system, wherein the processing system has a handling apparatus for the spectacle lenses and a linear guide on which the handling apparatus is arranged, wherein the linear guide is arranged parallel to the transport system, the handling apparatus is linearly movable along the linear guide parallel to the transport system and is assigned to a plurality of the several processing stations, and wherein the handling apparatus is configured to: transfer spectacle lenses between the transport system and at least one of the several processing stations, and to transfer spectacle lenses directly between two of the several processing stations.

2. The processing system according to claim 1, wherein the handling apparatus has a linear movement axis running at least partially above the transport system and/or obliquely to the vertical.

3. The processing system according to claim 1, wherein the processing system has several independent handling apparatuses, which are arranged above the transport system.

4. The processing system according to claim 1, wherein the handling apparatus has two holding devices on a swivel head configured for exchanging a spectacle lens at a processing station.

5. The processing system according to claim 1, wherein the handling apparatus is configured for the simultaneous exchange of spectacle lenses on two spectacle lens holders and/or chucks of a processing station.

6. The processing system according to claim 1, wherein the handling apparatus has a plurality of holding devices configured for holding spectacle lenses, the holding devices being arranged on different arms and/or being movable independently of one another.

7. The processing system according to claim 1, wherein the handling apparatus has two suction cups and two grippers configured to hold spectacle lenses.

8. The processing system according to claim 1, wherein the processing system has a further handling apparatus which is configured for the simultaneous exchange of tools on two tool holders of a processing station.

9. The processing system according to claim 1, wherein the processing system has a further handling apparatus with a plurality of holding devices configured for holding tools, the holding devices being arranged on different arms and/or being movable independently of one another.

10. The processing system according to claim 1, wherein the processing system has a further handling apparatus configured for exchanging tools, the further handling apparatus being assigned to two polishing stations and/or being arranged and/or movable between two polishing stations.

11. The processing system according to claim 1, wherein the processing system has a sensor, which is configured to determine whether one or more spectacle lenses are located in a transport container transported by the transport system.

12. The processing system according to claim 1, wherein the several processing stations of different type comprise a milling station, a turning station, a polishing station, a cleaning station and/or a signing station.

* * * * *